US006048060A

United States Patent [19]

Narushima et al.

[11] Patent Number: 6,048,060

[45] Date of Patent: Apr. 11, 2000

[54] PRINTING MEDIUM DISCHARGE APPARATUS USED IN AN INK JET PRINTER

[75] Inventors: Tsugio Narushima, Mishima; Akira Satou, Shizuoka-ken; Kyouichi Shibata, Mishima; Hiroaki Watanabe, Tanashi; Hiroshi Yamaguchi; Juntaro Oku, both of Numazu, all of Japan

[73] Assignee: Toshiba Tec Kabushiki Kaisha, Tokyo, Japan

[21] Appl. No.: 08/967,179

[22] Filed: Nov. 10, 1997

[30] Foreign Application Priority Data

Nov. 11, 1996 [JP] Japan ..... 8-298368
Jan. 8, 1997 [JP] Japan ..... 9-001203

[51] Int. Cl.[7] ..... G03G 15/00; B41J 2/01

[52] U.S. Cl. ..... 347/104; 347/102; 399/397; 399/400; 101/419

[58] Field of Search ..... 347/101, 102, 347/104; 399/397–400, 303–305; 400/625; 101/419; 271/69, 202

[56] References Cited

U.S. PATENT DOCUMENTS

| | | | |
|---|---|---|---|
| 4,268,841 | 5/1981 | Fujii et al. . | |
| 4,469,026 | 9/1984 | Irwin | 101/426 |
| 4,857,963 | 8/1989 | Sutou | 399/381 |
| 4,903,074 | 2/1990 | Lama et al. | 355/76 |
| 5,054,763 | 10/1991 | Achelpohl et al. | 271/202 X |
| 5,249,024 | 9/1993 | Menjo . | |
| 5,291,224 | 3/1994 | Asano et al. | 101/425 X |
| 5,356,231 | 10/1994 | Nakamura et al. | 400/625 X |
| 5,455,604 | 10/1995 | Adams et al. | 347/104 X |
| 5,459,562 | 10/1995 | Mitsuya et al. | 399/364 |
| 5,606,357 | 2/1997 | Bekki | 347/104 |
| 5,771,054 | 6/1998 | Dudak et al. | 347/102 |

FOREIGN PATENT DOCUMENTS 3-78267 12/1991 Japan .

*Primary Examiner*—Matthew S. Smith
*Attorney, Agent, or Firm*—Frishauf, Holtz, Goodman, Langer & Chick, P.C.

[57] ABSTRACT

A printing medium discharge apparatus used for discharging a printing medium from a rotary drum in an ink jet printer for printing a desired image onto the printing medium by an ink jet while holding the printing medium on the rotary drum, includes a printing medium carry and discharge device and a printing medium press device. The printing medium carry and discharge device carries thereon the printing medium from the rotary drum, on the printing medium an image having been printed, to make a non-image formation surface of the printing medium including no image formation region contact the printing medium carry and discharge device, and discharges the printing medium carried thereon to be moved apart from the rotary drum. The printing medium press device presses an image formation surface including an image formation region of the printing medium carried on the printing medium carry and discharge device, against the printing medium carry and discharge device, thereby to prevent the printing medium from floating up from the printing medium carry and discharge device while the printing medium is discharged by the printing medium carry and discharge device.

11 Claims, 16 Drawing Sheets

PRINTING MEDIUM DISCHARGE APPARATUS USED IN AN INK JET PRINTER

BACKGROUND OF THE INVENTION

The present invention relates to a printing medium discharge apparatus used in an ink jet printer, the printer printing a desired image by ink jet on a printing medium while it is held on a rotary drum, and the discharge apparatus discharging the printing medium, on which the desired image have been printed, from the rotary drum.

As personal computers have widely been marketed, their associated color printers are demanded for commercial use. Such conventional color printers are classified into serial, parallel, and line types depending on the mode of printing equipment.

A serial printing equipment includes a printing head having a plurality of ink jet nozzles for ejection of different colors (namely, yellow, magenta, cyan, and black). A conventional color printer provided with the serial printing equipment permits a printing medium such as a sheet of paper of a given size to be conveyed at equal intervals of a pitch in a predetermined direction. During the conveying, the printing head performs reciprocating motions over a surface of the printing medium at a right angle to the conveying direction of the printing medium. The printing head while traveling over the printing medium applies jets of specific inks to the surface of the printing medium at a given location in the reciprocating motion. As the printing head repeats application of the inks to the surface of the printing medium along the conveying direction, a desired image of the inks (which may include characters, numerals, symbols, etc.) is printed in a given area on the surface of the printing medium. The construction of such a conventional color printer provided with the serial printing equipment is well known. The conventional color printer has a printing head which can easily be fabricated and its overall arrangement is relatively simple, thus minimizing the size and lowering the cost. However, the conventional color printer has some disadvantages that the printing head is slow in the speed of printing action and produces a considerable degree of noise, hence being hardly suited for the business use which requires production of a large number of prints in a shorter duration of time with less sounds.

A conventional color printer provided with the parallel printing equipment allows a printing medium such as a sheet of paper of a given size to be conveyed at a specific speed in a predetermined direction under a plurality of printing units which are arranged at intervals of a given distance along the conveying direction. The printing units are parallel to each other extending at a right angle to the conveying direction between both sides of the printing medium. While the printing medium is conveyed at the specific speed in the conveying direction, different colors (namely, yellow, magenta, cyan, and black) are applied by their respective printing units to print an image on the printing medium. Each of the printing units comprises a photosensitive drum and a static charger, an exposer, a toner developer, a transfer device, a cleaner, and a discharger mounted about the photosensitive drum. The printing unit of this arrangement is known as used in a plain paper copier (PPC). The conventional color printer of this type is quiet during the printing action and high in the printing speed, and thus produces a large number of prints within a short period of time and can thus be suited for business use. However, the conventional color printer provided with the parallel printing equipment includes two or more of the printing units which are expensive and its construction is not simple, thus increasing the cost of production as well as the overall size.

A color printer provided with the line type printing equipment also permits a printing medium such as a sheet of paper of a given size to be conveyed at a specific speed in a predetermined direction under a plurality of printing head which are arranged at intervals of a given distance along the conveying direction. The printing heads are parallel to each other extending at a right angle to the conveying direction between both sides of the printing medium. Each of the printing heads includes a plurality of ink jet nozzles for ejection of one of different color inks (namely, yellow, magenta, cyan, and black). The ink jet nozzles on the printing head are aligned in a row extending at a right angle to the conveying direction between two sides of the printing medium. While the printing medium is conveyed at the specific speed in the conveying direction, the colors are applied by their respective printing heads.

As compared with the serial printing equipment, the line type printing equipment has the following advantages and disadvantage.

The printing head in the line type printing equipment has a greater number of the ink jet nozzles than that in the serial printing equipment and is thus very expensive. The line type printing equipment allows its printing heads to remain stationary to print a desired image on the printing medium which is conveyed and will thus be faster in the printing action and less noisy than the serial printing equipment.

As compared with the parallel printing equipment, the line type printing equipment has the following advantages and disadvantage.

The line type printing equipment has printing heads which are simpler in construction than those of the parallel printing equipment, so that the overall dimensions are small and the cost of production is low. Also, the printing speed of the line type printing equipment is equal to that of the parallel printing equipment. The line type printing equipment is however lower in resolution of prints on the printing medium than the parallel printing equipment.

Recently, for minimizing the overall size without sacrificing the printing speed, the color printer provided with the line type printing equipment is equipped with an improved device for conveying the printing medium.

A conventional color printer including the line type printing equipment which is more expensive than that with the serial printing equipment but less than that with the parallel printing equipment has been developed which is equal in printing speed, smaller in overall size, and slightly lower in the resolution of prints than that with the parallel printing equipment, and therefore, is now common for both business and personal uses.

For minimizing the overall size of a conventional color printer provided with the line type printing equipment without decreasing the printing speed, the device for conveying the printing medium includes a rotary drum having an outer surface thereof facing a plurality of printing heads of the line type printing equipment and a printing medium holding device for detachably holding the printing medium to the outer surface of the rotary drum with certainty. In action, while the rotary drum is rotated a number of times with the printing medium detachably held to its outer surface by the printing medium holding device, the printing heads print down a desired image of different color inks on the printing medium.

In order to increase the printing speed of the conventional color printer which comprises the line type ink jet printing equipment using the rotary drum as a printing medium conveying device of a small size, it is needed to increase a printing medium discharge speed of a printing medium discharge apparatus used for discharging the printing medium from the rotary drum after the desired image is printed on the medium.

BRIEF SUMMARY OF THE INVENTION

An object of the present invention is to provide a printing medium discharge apparatus which is used in an ink jet printer using a rotary drum as a printing medium conveying device, to discharge a printing medium on which an image has been printed, from the rotary drum, and which can securely discharge the printing medium without staining an image formation region of the printing medium and jamming of the printing medium, when a speed for discharging the printing medium on which the image have been printed, from the rotary drum is increased.

An ink jet printer using a rotary drum as a printing medium conveying device, and also using the printing medium discharge apparatus described above, can increase a printing speed without deteriorating the quality of printed images on the printing medium, hence decreasing the resolution of the printed images.

In order to achieve the above described object of this invention, the printing medium discharge apparatus according to the present invention and used in the ink jet printer, comprises:

a printing medium carry and discharge device carrying thereon the printing medium from the rotary drum, on the printing medium an image having been printed, to make a non-image formation surface of the printing medium including no image formation region contact the printing medium carry and discharge device, and for discharging the printing medium carried thereon to be moved apart from the rotary drum; and a printing medium press device pressing an image formation surface including an image formation region of the printing medium carried on the printing medium carry and discharge device, against the printing medium carry and discharge device, thereby to prevent the printing medium from floating up from the printing medium carry and discharge device while the printing medium is discharged by the printing medium carry and discharge device.

With such a printing medium discharge apparatus as described above, the printing medium press device presses and prevents the printing medium from floating on the printing medium carry and discharge device even if the speed for discharging the printing medium on which the image have been printed, from the rotary drum is increased. Therefore, the printing medium discharge apparatus securely prevents the printing medium from moving relative to the printing medium carry and discharge device and the printing medium press device therebetween. As a result, the above described printing medium discharge apparatus can securely discharge the printing medium without staining the image formation region of the printing medium and jamming of the printing medium.

In order to achieve the above described object of this invention, another printing medium discharge apparatus according to the present invention and used in the ink jet printer, comprises:

an ink drying device drying ink in an image formation region of the printing medium being discharged by the printing medium discharge apparatus, and wherein the printing medium discharge apparatus discharges the printing medium at a speed equal to a circumferential speed of an outer circumferential surface of the rotary drum until a rear end of the printing medium from the rotary drum is separated from the rotary drum, and discharges the printing medium at a speed lower than the circumferential speed of the outer circumferential surface of the rotary drum after the rear end of the printing medium is separated from the rotary drum until a next printing medium on which an image is printed is introduced into the printing medium discharge apparatus.

With such a printing medium discharge apparatus as described above, since the apparatus can discharge the printing medium on which the image have been printed from the rotary drum at the speed lower than the circumferential speed of the outer circumferential surface of the rotary drum after the rear end of the printing medium is separated from the rotary drum until a next printing medium on which an image have been printed is introduced into the apparatus, the apparatus prevents the printing medium from floating on the printing medium carry and discharge device even if the speed for discharging the printing medium on which the image have been printed from the rotary drum is increased, and further the apparatus ensures enough times to dry ink in the image formation region of the printing medium during the printing medium is discharged. As a result, the above described another printing medium discharge apparatus can surely discharge the printing medium without staining the image formation region of the printing medium and jamming of the printing medium.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Preferred embodiments of the present invention and their modifications will be described in detail referring to the accompanying drawings.

Figure 1:
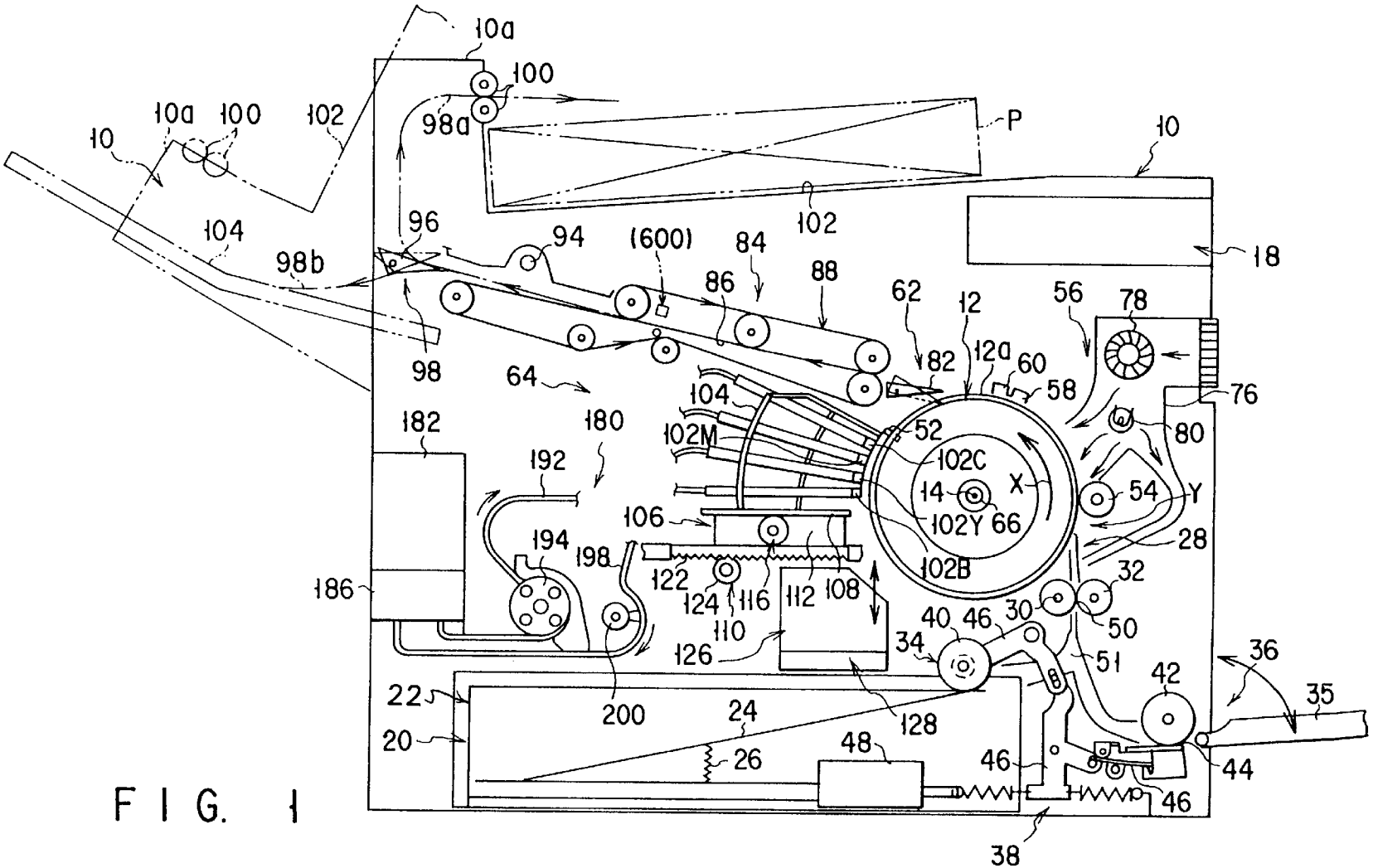
FIG. 1 is a schematic longitudinal cross sectional view of an ink jet printer provided with a printing medium discharge apparatus according to the present invention.

FIG. 1 is a longitudinal cross sectional view of a preferred embodiment of an ink jet printer provided with a printing medium discharge apparatus according to the present invention.

Referring to FIG. 1, the rotary drum 12 of the ink jet printer is rotatably supported in the inner space of a housing 10. The rotary drum 12 has an outer surface 12*a* thereof substantially disposed coaxially of the center of rotation 14 and is driven at a predetermined speed in a specific direction (namely, the counter-clockwise direction denoted by X in FIG. 1) to selectively perform a desired number of rotations by the force of rotation from a rotation power source not shown, such as a motor, under the control with a controller unit 18 mounted at an upper region of the inner space of the housing 10.

A printing medium storage means 20 is mounted beneath the rotary drum 12 in the inner space of the housing 10. The printing medium storage means 20 in the embodiment includes a cassette 22 for storage of sheets of plain paper of a desired rectangular size. The cassette 22 is detachably installed in the housing 10 for loading and unloading the paper sheets on a defined location thereof. A printing medium loading plate 24 is mounted at defined position in the cassette 22 for lifting up and down and remains urged upwardly by an urging member 26.

A printing medium feeding device 28 is provided between the rotary drum 12 and the printing medium storage device 20 in the inner space of the housing 10, which supplies the paper sheets as the printing mediums to a specific location on the outer surface 12*a* of the rotary drum 12 at a given timing controlled by the controller unit 18 to synchronize with the circumferential speed of the outer surface 12*a* of the rotary drum 12. The printing medium feeding device 28 in the embodiment comprises a pair of transfer rollers 30 and 32 located adjacent to the outer surface 12*a* of the rotary drum 12, a cassette-side printing medium feeding mechanism 34 mounted between the paired transfer rollers 30 and 32 and the cassette 22, and a tray-side printing medium feeding mechanism 36 mounted between the paired transfer rollers 30 and 32 and a manual printing medium supply tray 35 located outside the housing 10 adjacent to the cassette 22. The cassette-side printing medium feeding mechanism 34 is designed for selectively feeding the paper sheets loaded on the printing medium loading plate 24 in the cassette 22, one by one from the uppermost of their stack, to between the paired rollers 30 and 32. The tray-side printing medium feeding mechanism 36 is adapted for feeding each of the paper sheets manually loaded in the manual printing medium supply tray 35 to between the paired rollers 30 and 32.

Both the cassette-side printing medium feeding mechanism 34 and the tray-side printing medium feeding mechanism 36 are driven by a common rotating drive source (a motor) not shown and their feeding actions are switched from one to the other by an action switching mechanism 38 provided between the two mechanisms 34 and 36.

More specifically, the cassette-side printing medium feeding mechanism 34 has a pick-up roller 40 provided in direct contact with the uppermost of the stack of the paper sheets loaded on the printing medium loading plate 24 in the cassette 22. The tray-side printing medium feeding mechanism 36 has a printing medium input roller 42 located adjacent to an input opening of the housing 10 through which the printing medium is fed from the manual printing medium supply tray 35. Both the pick-up roller 40 of the cassette-side printing medium feeding mechanism 34 and the printing medium input roller 42 of the tray-side printing medium feeding mechanism 36 are connected via a known rotation transmitting mechanism such as a train of toothed wheels, not shown, to a common rotation drive source not shown (a bi-directional motor). When the common rotation drive source (or bi-directional motor) rotates in one direction, its rotation is transmitted to the pick-up roller 40.

When the common rotation drive source rotates in the other direction, its rotation is transmitted to the printing medium input roller 42. The tray-side printing medium feeding mechanism 36 also has a friction strip 44 provided opposite to the printing medium input roller 42. The friction strip 44 of the tray-side printing medium feeding mechanism 36 is connected by a link member 46 of the action switching mechanism 38 to the pick-up roller 40 of the cassette-side printing medium feeding mechanism 34. The link member 46 is linked to a known actuator 48. When the actuator 48 is turned on and off, the link member 46 actuates the pick-up roller 40 and the friction strip 44 to move between the action position and the rest position. At the action position, the pick-up roller 40 comes into direct contact with the uppermost of the paper sheets in a stack loaded on the printing medium loading plate 24 in the cassette 22 and the friction strip 44 of the tray-side printing medium feeding mechanism 36 touches or comes close to the printing medium input roller 42. At the rest position, the pick-up roller 40 departs from the uppermost of the paper sheets loaded on the printing medium loading plate 24 in the cassette 20 and the friction strip 44 is spaced from the printing medium input roller 42.

When the pick-up roller 40 is driven by the rotation of the unshown common rotation drive source (or bi-directional motor) and moved to the action position, it picks up and feeds the uppermost of the paper sheets from the printing medium loading plate 24 in the cassette 20 to between the paired transfer rollers 30 and 32. When the printing medium input roller 42 is driven by the rotation of the unshown common rotation drive source (or bi-directional motor) with the friction strip 44 moved to the action position, it feeds the printing medium manually supplied to the manual printing medium supply tray 35 to between the paired transfer rollers 30 and 32.

There is a known detecting device such as an optical sensor, not shown, provided just before the contact line 50 between the paired transfer rollers 30 and 32 for detecting the leading end of the printing medium supplied from the cassette 20 or the manual printing medium supply tray 35. The distance of travel of the printing medium from the pick-up roller 40 of the cassette-side printing medium feeding mechanism 34 to the contact line 50 and the distance of travel of the printing medium from the printing medium input roller 42 of the tray-side printing medium feeding mechanism 36 to the contact line 50 both are shorter than the length of the printing medium defined in the direction of travel. When a specified length of time has passed after the detecting device detected the leading end of the printing medium, the pick-up roller 40 of the cassette-side printing medium feeding mechanism 34 and the friction strip 44 of the tray-side printing medium feeding mechanism 36 are switched from the action position to the rest position. This allows the printing medium fed from either the cassette-side printing medium feeding mechanism 34 or the tray-side printing medium feeding mechanism 36 to be unrestrained with its leading end reaching the contact line 50 in a loose space 51 defined across the path of the printing medium between the pick-up roller 40 of the cassette-side printing medium feeding mechanism 34 and the contact line 50 or between the printing medium input roller 42 of the tray-side printing medium feeding mechanism 36 and the contact line 50. As the printing medium touches the contact line 50, its skew to the contact line 50 can be corrected.

After the leading end of the printing medium is detected by the detecting device and touches the contact line 50 but before the pick-up roller 40 and the friction strip 44 are shifted to the rest position, the paired transfer rollers 30 and 32 are rotated through a predetermined angle. This rotating motion of the paired transfer rollers 30 and 32 permits the leading end of the printing medium to insert between the paired transfer rollers 30 and 32. The rotating motion is terminated by a known detecting device such as an optical sensor, not shown, which is located at the exit side of the paired transfer rollers 30 and 32, detecting the leading end of the printing medium passing the contact line 50 between the paired transfer rollers 30 and 32. Since the leading end of the printing medium is being inserted between the paired transfer rollers 30 and 32, it is prevented from returning from the contact line 50 to the cassette 20 or the manual printing medium supply tray 35 after the shifting of the pick-up roller 40 and the friction strip 44 to the rest position. Also, the shifting of the pick-up roller 40 and the friction strip 44 to the rest position avoids untimed supply of two consecutive printing mediums from the cassette 20 or the manual printing medium supply tray 35.

As the leading end of the printing medium has been inserted between the paired transfer rollers 30 and 32, it is driven at predetermined timing to a given location Y over the outer surface 12*a* of the rotary drum 12 by the paired transfer rollers 30 and 32 controlled by the control unit 18. The speed of the printing medium by the paired feeder rollers 30 and 32 for driving the printing medium is identical to the circumferential speed at the outer surface 12*a* of the rotary drum 12.

Denoted by 52 in FIG. 1 is a known detecting device such as an optical sensor which is located close to the outer surface 12*a* of the rotary drum 12 for detecting a particular point (namely, the location of a printing medium holding finger described later) on the outer surface 12*a* of the rotary drum 12. When the detecting device 52 detects the particular point on the outer surface 12*a* of the rotary drum 12, the control unit 18 determines a timing for starting the action of the paired transfer rollers 30 and 32 so that the leading end of the printing medium comes to the location Y in synchronism with the particular point of the outer surface 12*a* of the rotary drum 12 arriving at the point Y.

An initial charger 54, a preheating device 56, a sub-charger 58, a discharger 60, a printing medium removing device 62, and an ink using printing equipment 64 are mounted in this order from the location Y along the direction of rotation X of the rotary drum 12 about the outer surface 12*a* of the rotary drum 12.

The initial charger 54 in the embodiment comprises a charging roller for pressing the printing medium onto the rotary drum 12 and applying positive charges to the printing medium on the outer surface 12*a* of the rotary drum 12 which rotates in the direction X at the predetermined circumferential speed with the printing medium supplied and loaded by the paired feeder rollers 30 and 32 from the cassette 20 or the manual printing medium supply tray 35. When the printing medium has been moved to the location Y over the outer surface 12*a* of the rotary drum 12 by the driving action of the paired transfer rollers 30 and 32, it is held with the printing medium holding finger which is located at the particular point on the outer surface 12*a* of the rotary drum 12 as will be described later and secured by electrostatic attraction of the charges to the outer surface 12*a* of the rotary drum 12. The circumferential length of the outer surface 12*a* of the rotary drum 12 is longer than the length of the printing medium defined in the direction of travel and the width along the center line 14 of rotation is greater than the width of the printing medium. In this embodiment, the printing medium is a sheet of the A4 size, 297 mm long by 210 mm wide, defined in the Japanese Industrial Standard (JIS).

The charging roller of the initial charger 54 is pressed against the outer surface 12*a* of the rotary drum 12 until the printing medium supplied from the paired transfer rollers 30 and 32 is attached throughout its length by the suction to the outer surface 12*a* of the rotary drum 12 and can thus assist the attachment of the printing medium to the outer surface 12*a* of the rotary drum 12.

The rotary drum 12 in the embodiment is made of an aluminum alloy, has a diameter of 130 mm and a width of 220 mm at the outer surface 12*a*. Then, the circumferential length of the outer surface 12*a* of the rotary drum 12 is expressed by the diameter of the outer surface 12*a*×π=408 mm. If it is desired to have the circumferential length of the outer surface 12*a* of the rotary drum 12 increased longer than that of the A4 size, the diameter of the outer surface 12*a* of the rotary drum 12 is 100 mm or more.

Figure 2:
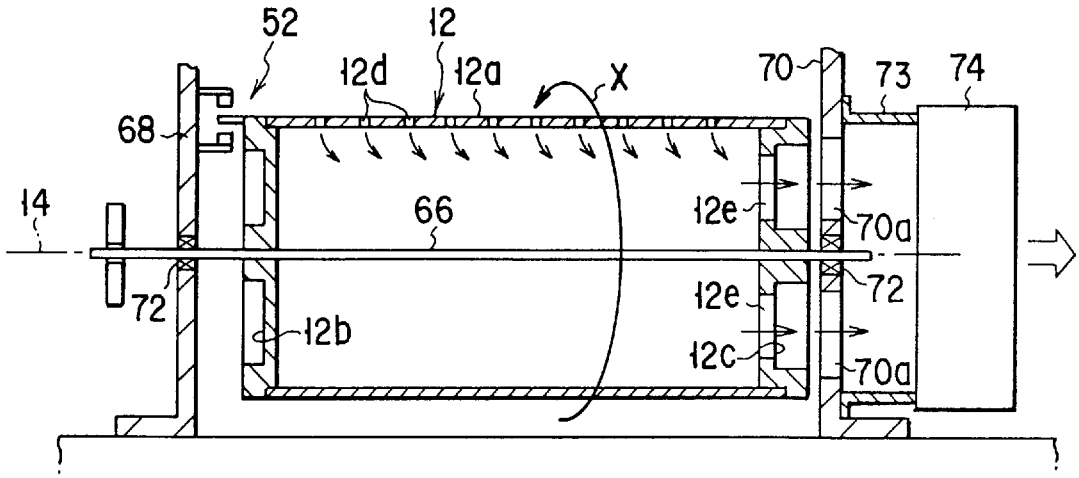
FIG. 2 is a schematic longitudinal cross sectional view showing the rotary drum with a negative pressure generator which is a member of a printing medium suction unit in the ink jet printer shown in FIG. 1.

FIG. 2 illustrates a cross section of a construction, taken along the center line of rotation 14, for supporting the rotary drum 12 in the housing 10. As shown in FIG. 2, the rotary drum 12 has a rotation center shaft 66 extending coaxially of the center line of rotation 14. Both ends of the rotation center shaft 66 extend outwardly from two ends 12*b* and 12*c* of the rotary drum 12 and are rotatably supported by bearings 72 on support brackets 68 and 70 respectively in the housing 10. One end of the rotation center shaft 66 is connected via a known power transmission unit not shown to a known rotation drive source such as a servo motor, not shown, which is advantageous in the response and the constant speed. The rotary drum 12 in the embodiment may be driven at a constant rate of 120 r.p.m. in the direction X of rotation by the known rotation drive source. More specifically, the rotary drum 12 rotates at a speed of 120 (rpm)×π×130 (diameter in mm)/60=816 mm/sec in the direction X and thus takes 0.5 second for one full rotation.

As shown in FIG. 2, the outer surface 12*a* of the rotary drum 12 has a number of suction apertures 12*d* provided in a belt-like region, adjacent to the particular point, of the outer surface 12*a* of the rotary drum 12 which extends widthwisely of the rotary drum 12 along the center line of rotation 14. One side 12*c* of the rotary drum 12 has a through opening 12*e* therein. Also, the support bracket 70 located opposite to the side 12*c* of the rotary drum 12 has a through opening 70*a* therein. A suction fan device 74 is mounted by a suction duct 73 to the opposite side of the support bracket 70 to the side 12*c* of the rotary drum 12. While the rotary drum 12 rotates, the suction fan device 74 generates and passes a flow of air, denoted by the arrow in FIG. 2, from the suction apertures 12*d* in the outer surface 12*a* of the rotary drum 12 via the suction fan device 74 to the through opening 12*e* of the rotary drum 12 and the through opening 70*a* of the support bracket 70. This develops a negative pressure, at the particular point on the outer surface 12*a* of the rotary drum 12, which in turn holds the leading end of the printing medium supplied to the location Y over the outer surface 12*a* of the rotary drum 12 by the action of the paired transfer rollers 30 and 32. Accordingly, the leading end of the printing medium at the location Y is securely attached to the particular point of the outer surface 12*a* of the rotary drum 12 by a combination of the electrostatic attraction of the charges and the negative pressure. As the result, the holding of the leading end of the printing medium with the printing medium holding finger described later will be carried out without difficulty.

A radially opened gap of the rotary drum 12 is provided between the side 12*c* of the rotary drum 12 and the support bracket 70. This minimizes a difference in the load of suction to the suction fan device 74 between the attraction of the printing medium by suction through the suction apertures 12*d* in the outer surface 12*a* of the rotary drum 12 and the non-attraction of the same.

For attracting the leading end of the printing medium to the particular location by suction, the suction apertures 12*d* may be arranged in a band-like region of the outer surface 12*a* of the rotary drum 12 as described or throughout the entire area of the outer surface 12*b*.

The preheating device 56 shown in FIG. 1 comprises an air input duct 76 mounted in the inner space of the housing 10, a blow fan 78 installed in the air input duct 76, and a heater 80 mounted between the outer surface 12*a* of the rotary drum 12 and the blow fan 78 in the air input duct 76. The air input duct 76 in the embodiment extends from an air intake opening provided in the housing 10 and is separated into two branches to the path of the printing medium between the location Y over the outer surface 12*a* of the rotary drum 12 and the paired transfer rollers 30 and 32 and to the downstream of the initial charger 54 over the outer surface 12*a* along the direction of rotation X of the rotary drum 12.

In action, the first of the two branches of the air input duct 76 decreases the moisture of the printing medium running along the path so the printing medium can easily be attached at the location Y to the outer surface 12*a* of the rotary drum 12 by the attraction of the charges which has been developed with the initial charger 54.

The second branch of the air input duct 76 dries an image of ink printed by the printing equipment 64 on the printing medium which has securely been held to the outer surface 12*a* of the rotary drum 12 at the leading end by the printing medium holding finger, not shown, and at the remaining part by the electrostatic attraction of the charges developed by the initial charger 54 and the negative pressure generated by the suction fan device 74 (FIG. 2).

However, the preheater 56 may be eliminated when the electrostatic attraction of the charges is strong enough to hold the printing medium and the ink image on the printing medium is instantly dried out by a blow of air produced by the rotation of the rotary drum 12. In that case, one of the branches of the air input duct 76 is eliminated while the other being utilized.

In this embodiment, when the printing medium has been held by the suction to the outer surface 12*a* of the rotary drum 12, the rotary drum 12 is driven at the predetermined circumferential speed in the direction X under the control of the control unit 18 to perform a number of rotations required for printing the image of ink with the printing equipment 64. During the rotations of the drum 12, the charging roller of the initial charger 54 runs over the single printing medium and departs from the outer surface 12*a* of the rotary drum 12. As the rotary drum 12 rotates more than two rotations, the electrostatic attraction charged on the outer surface 12*a* of the rotary drum 12 by the charging roller of the initial charger 54 may be reduced due to performing the full-color printing of the ink jet by the printing equipment so that the printing medium is left up from the outer surface 12*a* of the rotary drum 12.

For compensation, the sub-charger 58 is provided for applying positive charges to the printing medium which passes beneath the sub-charger 58 when two or more of the rotations of the drum 12 are needed for printing a desired ink image on the printing medium with the printing equipment 64. The quantity of the positive charges applied by the sub-charger 58 to the printing medium when passing beneath the sub-charger 58 is smaller than that applied by the charging roller of the initial charger 54 to the printing medium on the outer surface 12*a* of the rotary drum 12. The sub-charger 58 is of non-contact type which remains spaced from the outer surface 12*a* of the rotary drum 12 not to impair the ink image printed by the printing equipment 64 on the printing medium on the outer surface 12*a* of the rotary drum 12. The non-contact type of the sub-charger 58 may be a corona charger.

The sub-charger 58 may be eliminated in the following case. If the initial charger 54 is of non-contact type such as a corona charger, its generation of the positive charges in a given time is specified in two, high and low, levels which are selectable. The non-contact type of the initial charger 54 serves as the initial charger when its generation of the positive charges is at the high level and as the sub-charger when it is at the low level. Meanwhile, the printing medium is securely attached throughout the length to the outer surface 12*a* of the rotary drum 12 by the negative pressure of the printing medium suction unit. It is apparent that any printing medium which has wrinkles while being attached by suction to the outer surface 12*a* of the rotary drum 12 may cause an ink image printed by the printing equipment 64 to be declined in the quality.

As described above, the initial charger 54, the sub-charger 58, and the suction unit (including the suction apertures 12*d* in the outer surface 12*a* of the rotary drum 12, the through holes 12*e* in the side 12*c* of the rotary drum 12, the through hole 70*a* in the support bracket 70, and the suction fan device 74) definitely constitute in a combination the printing medium suction unit for attaching the printing medium to the outer surface 12*a* of the rotary drum 12 by suction.

The discharger 60 in the embodiment is of non-contact type such as a corona charger. The discharger 60 applies negative charges, which are opposite in polarity to the positive charges applied by the initial charger 54 and the sub-charging means 58, to the printing medium on the outer surface 12*a* of the rotary drum 12 when the rotary drum 12 has rotated a specific number of times for allowing the printing equipment 64 to print a desired image of ink on the printing medium held on the outer surface 12*a* of the rotary drum 12.

The printing medium removing device 62 in the embodiment is provided with a peel-off finger 82. The peel-off finger 82 is mounted extending in parallel to the center line of rotation 14 of the rotary drum 12 or along the widthwise direction of the rotary drum 12 as shown in FIG. 1. In action, the peel-off finger 82 is driven by a known actuator not shown for selectively swinging between the rest position, denoted by the solid line in FIG. 1, spaced from the outer surface 12*a* of the rotary drum 12 and the action position, denoted by the two-dot chain line in FIG. 1, directly on the outer surface 12*a* of the rotary drum 12.

The peel-off finger 82 is normally located at the rest position denoted by the solid line. When the rotary drum 12 has rotated a specific number of times for allowing the printing equipment 64 to print a desired ink image on the recording medium held by suction to the outer surface 12*a* of the rotary drum 12, the peel-off finger 82 moves from the rest position to the action position. More particularly, as the rotary drum 12 has completed the specific number of rotations, the printing medium holding finger not shown is moved back to its release position to release the holding of the leading end of the printing medium to the outer surface 12*a* of the rotary drum 12 and simultaneously, the discharger 60 cancels the electrostatic attraction for attaching the printing medium to the outer surface 12*a* of the rotary drum 12. Accordingly, the peel-off finger 82 when moved to its action position can remove the leading end and the remaining portion of the printing medium from the outer surface 12*a* of the rotary drum 12 with much ease.

The printing medium removing device 62 may be constructed in other fashion than the motion of the peel-off finger 82, for example, using the attraction of negative pressure, the ejecting force of compressed air, or the kinetic motion of pick-up mechanism.

The printing medium removing device 62 is communicated to a printing medium discharge apparatus 84 which extends to a position in the housing 10 located near to the side wall and the top wall thereof.

Figure 3A:
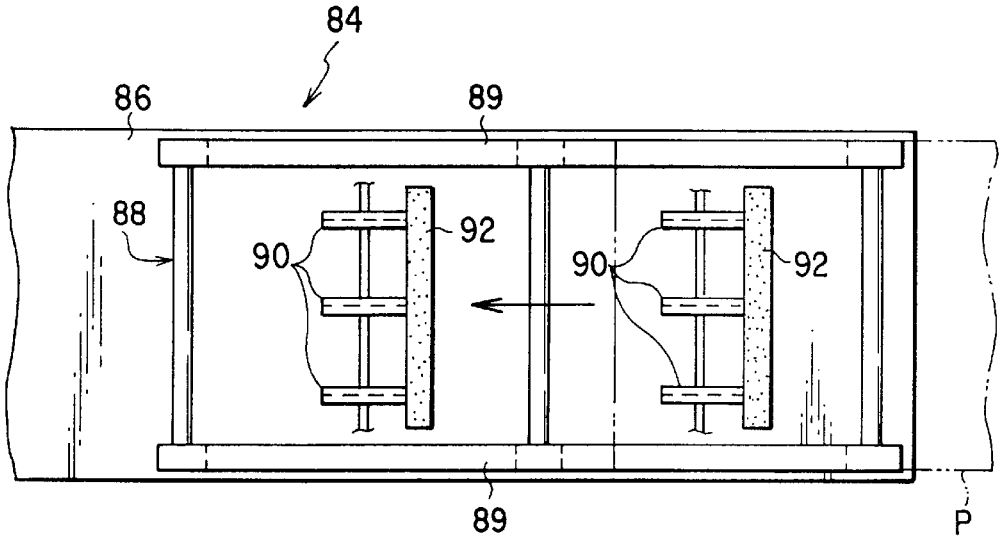
FIG. 3A is a schematic plan view of the printing medium discharge apparatus in the ink jet printer shown in FIG. 1.
Figure 3B:
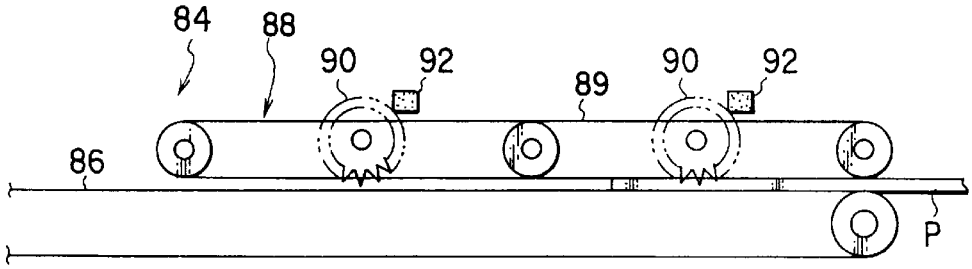
FIG. 3B is a schematic side view of the printing medium discharge apparatus shown in FIG. 3A.
Figure 3C:
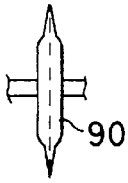
FIG. 3C is a front view of a hold-down roller used in the printing medium discharge apparatus shown in FIG. 3A.

FIG. 3A is an enlarged plan view of a primary part of the printing medium discharge apparatus 84. FIG. 3B is an enlarged side view of the primary part of the printing medium discharge apparatus 84 shown in FIG. 3A. FIG. 3C is an enlarged front view of a hold-down roller in the printing medium discharge apparatus 84 shown in FIG. 3A.

Referring to FIGS. 3A to 3C as well as FIG. 1, the printing medium discharge apparatus 84 in the embodiment includes a printing medium carry and discharge device 86 on which the printing medium P removed from the outer surface 12*a* of the rotary drum 12 by the printing medium removing device 62 is carried with its lower side (the non-printed side) down. The printing medium carry and discharge device 86 can run at substantially the same speed as of the circumferential speed of the outer surface 21*a* of the rotary drum 12 to convey the printing medium P away from the rotary drum 12.

In this embodiment, the printing medium carry and discharge device 86 is structured by a belt conveyer.

The printing medium discharge apparatus 84 of this embodiment further comprises a printing medium press device 88 for pressing the printing medium P carried on the printing medium carry and discharge device 86, against the carry and discharge device 86. The press device 88 is arranged above the printing medium carry and discharge device 86 and includes a pair of belt unit 89 arranged at two positions corresponding the both end portions (that is, two no-printing regions in the image formation surface) of the printing medium P in the width direction of the medium P on the carry and discharge device 86. The paired belt units 89 extend in a direction in which the printing medium P is discharged by the carry and discharge device 86.

The paired belt units 89 are rotatable in the discharge direction of the printing medium P on the carry and discharge device 86 and press the both end portions of the printing medium P carried on the printing medium carry and discharge device 86, the both ends being located in the width direction of the medium P, against the carry and discharge device 86. This prevents the printing medium P from floating on the carry and discharge device 86 while the printing medium P is discharged by the carry and discharge device 86, so that a falling of the printing medium P from the carry and discharge device 86 and a collision of the printing medium P with something located around the carry and discharge device 86, both falling and collision of the medium P being caused by the floating of the medium P, are prevented and jamming of the medium P will not be happened. The paired press belt units 89 of the printing medium press device 88 do not stain a region (that is, the image formation region in the image formation surface) between the both end portions of the upper surface of the printing medium P.

The printing medium press device 88 in the embodiment further includes a plurality of press rollers 90 mounted between the pair of press belt units 89 above the carry and discharge device 86 to face the region (or the image formation region of the upper side of the printing medium) between the both end portions of the printing medium P carried on the carry and discharge device 86. Each of the press rollers 90 is rotatable in the discharge direction of the printing medium P on the carry and discharge device 86 and is pressed against the carry and discharge device 86 in the region (or the image formation region of the upper side of the printing medium) between the both end portions of the printing medium P carried on the carry and discharge device 86. To prevent unwanted damage or stain to the region (or the image formation region of the upper side of the printing medium) between the both end portions of the printing medium P carried on the carry and discharge device 86, the outer edge of the press roller 90 has a width smaller enough to hold the printing medium P intact and is shaped of e.g. a star pattern on the side by dividing the outer edge into a plurality of projections with a plurality of notches separated from each other in the circumferential direction of the roller 90. The outer edge of the press roller 90 is kept in direct contact with an ink cleaning member 92 such as a sponge or felt material for cleaning on the roller 90 to protect the image formation region of the printing medium P. The hold press rollers 90 prevent the printing medium P from lifting up from the upper surface of the carry and discharge device 86 when being discharge thereon. Accordingly, as the printing medium P is prevented from lifting up or dropping off from the carry and discharge device 86, it will hardly cause a collision or a jamming on the carry and discharge device 86. The press rollers 90 rarely assault and impair the region (or the image formation region of the upper side of the printing medium) between the both end portions of the printing medium P carried on the carry and discharge device 86.

The length of the printing medium carry and discharge device 86 in the discharging direction of the printing medium P on the carry and discharge device 86 is set longer than that of the paired press belt units 89 of the printing medium press device 88 in the discharging direction, and a space in which the press device 88 is not located is produced above the downstream end portion of the carry and discharge device 86 in the discharging direction. An ink drying device 94 is mounted in the space above a downstream region of the carry and discharge device 86 for drying the ink of the image printed on the upper side of the printing medium P conveyed on the carry and discharge device 86. The ink drying device 94 is preferably a known heater. The ink drying device 94 may be eliminated if the ink of the image printed on the upper side of the printing medium P can be dried out before removed by the printing medium removing device 82 from the outer surface 12*a* of the rotary drum 12 to the carry and discharge device 86.

A printing medium discharge direction switching device 96 is provided at the terminal end of the downstream region of the carry and discharge device 86 in the housing 10. The switching device 96 comprises a known gate member for selectively guiding the printing medium in either the vertical or horizontal direction after the printing medium arrives at the terminal end of the downstream region of the carry and discharge device 86.

The switching device 96 for selecting the discharging direction of the printing medium P from the carry and discharge device 86 is connected at the downstream side to a printing medium discharge guide 98 which defines a path for discharging the printing medium and comprises two branches. One branch 98*a* of the printing medium discharge guide 98 extends upwardly from the switching device 96 and is communicated at the exit end to an opening provided in the top of the housing 10. At the exit end, a pair of discharge rollers 100 are mounted for discharging the printing medium P discharged from the terminal end of the downstream portion of the carry and discharge device 86 to the switching device 96 and the branch 98*a* of the printing medium discharging guide 98. The printing medium P discharged by the paired discharge rollers 100 is then deposited with its printed side down in a stack on a printing medium stacker 102.

The other branch 98*b* of the printing medium discharging guide 98 extends horizontally from the switching device 96 and is communicated at the exit end with an opening provided in the side of the housing 10. A discharged printing medium tray 104 is detachably or openably mounted to the side of the housing 10 for communication via the opening to the exit end of the horizontal branch 98*b*. The printing medium P discharged from the opening is deposited with its printed side up in a stack on the discharged printing medium tray 104.

In this embodiment, the housing 10 is arranged openable at the top 102 for maintenance service for the components mounted in the inner space of the housing 10. The housing 10 when is in its open state is denoted at the top 102 by the two-dot chain line in FIG. 1. The housing 10 may be openable on the side(s) for ease of the maintenance service.

The printing equipment 64 in the embodiment comprises a group of ink jet printing heads 102C, 102M, 102Y, and 102B arranged at equal distance from each other along the outer surface 12*a* of the rotary drum 12 circumferentially of the drum 12. The printing heads 102C, 102M, 102Y, and 102B extend parallel to each other and to the center line of rotation 14 of the rotary drum 12 and along the radial direction of the rotary drum 12.

The printing heads 102C, 102M, 102Y, and 102B are supportedly mounted by a support 104 to a forward and backward movable table 108 in an axially traveling mechanism 106. The axially traveling mechanism 106 is mounted by a radially traveling mechanism 110 to a particular location in the inner space of the housing 10.

The axially traveling mechanism 106 is designed for selectively moving the printing heads 102C, 102M, 102Y, and 102B within a given reciprocating range along the center line of rotation 14 of the rotary drum 12. As schematically shown in a plan view of FIG. 4, the axially traveling mechanism 106 also includes a frame 112 supported on the radially traveling mechanism 110 shown in FIG. 1 and a plurality of guide bars 114 extending along and in parallel with the center line of rotation 14 of the rotary drum 12 and with each other. The forward and backward movable table 108 is mounted on the guide bars 114 for forward and backward movements in a specific reciprocating range along the center line of rotation 14 of the rotary drum 12.

A forward and backward movement drive source 116 is mounted to one side of the frame 112, which is a known shaft-projectable/retractable step motor 118 in the embodiment. The shaft-projectable/retractable step motor 118 has an output shaft 119 arranged movable in a specific reciprocating range along its axis corresponding to the direction of rotation and the angle of rotation. One end of the output shaft 119 is rotatably linked to a corresponding side of the forward and backward movable table 108. A rattling preventing urging member 120 is mounted between the side of the frame 112 and the corresponding side of the forward and backward movable table 108 for urging the forward and backward movable table 108 in a direction parallel to the guide bars 114. The rattling movement preventing urging member 120 may be a compression spring or a tension spring.

The radially traveling mechanism 110 is designed for selectively moving the printing heads 102C, 102M, 102Y, and 102B to and from the outer surface 12*a* of the rotary drum 12 radially of the same.

As shown in FIG. 1, the radially traveling mechanism 110 comprises a rack 122 located beneath the frame 112 of the axially traveling mechanism 106 to extend radially of the rotary drum 12 and a pinion 124 engaged with the rack 122. The pinion 124 is rotatably mounted on a support, not shown, anchored in the housing 10 and driven by the rotation of a rotation drive mechanism such as a motor not shown. The radially traveling mechanism 110 drives the printing heads 102C, 102M, 102Y, and 102B to move away from their respective printing locations, shown in FIG. 1, together with the axially traveling mechanism 106 when they are not in use for more than a predetermined length of time and return back from their away locations to the printing locations together with the radial traveling mechanism 106 when they are requested for use.

In this embodiment, a printing heads protective mechanism 126 is provided beneath the radially traveling mechanism 110 in the inner space of the housing 10. The printing heads protective mechanism 126 is mounted on a vertically traveling mechanism 128 located in the inner space of the housing 10. The vertically traveling mechanism 128 is designed for selectively moving the printing heads protective mechanism 126 in upward and downward directions. More particularly, while the printing heads 102C, 102M, 102Y, and 102B are at their printing locations, shown in FIG. 1, with the radially traveling mechanism 110, the vertically traveling mechanism 128 holds the printing heads protective mechanism 126 to its lowermost location shown in FIG. 1. When the printing heads 102C, 102M, 102Y, and 102B have been moved from the printing locations, shown in FIG. 1, to the away locations by the radially traveling mechanism 110, the vertically traveling mechanism 128 drives the printing heads protective mechanism 126 from the lowermost location, shown in FIG. 1, to the uppermost location where it is situated between the ink jet nozzle ends (facing the outer surface 12*a* of the rotary drum 12) of the printing heads 102C, 102M, 102Y, and 102B at their away locations and the outer surface 12*a* of the rotary drum 12. The printing heads protective mechanism 126 at the uppermost location covers over the ink jet nozzle ends, not shown, of the printing heads 102C, 102M, 102Y, and 102B to protect their ink ejecting apertures and prevent them from fouling with remaining of the ink.

Figure 5:
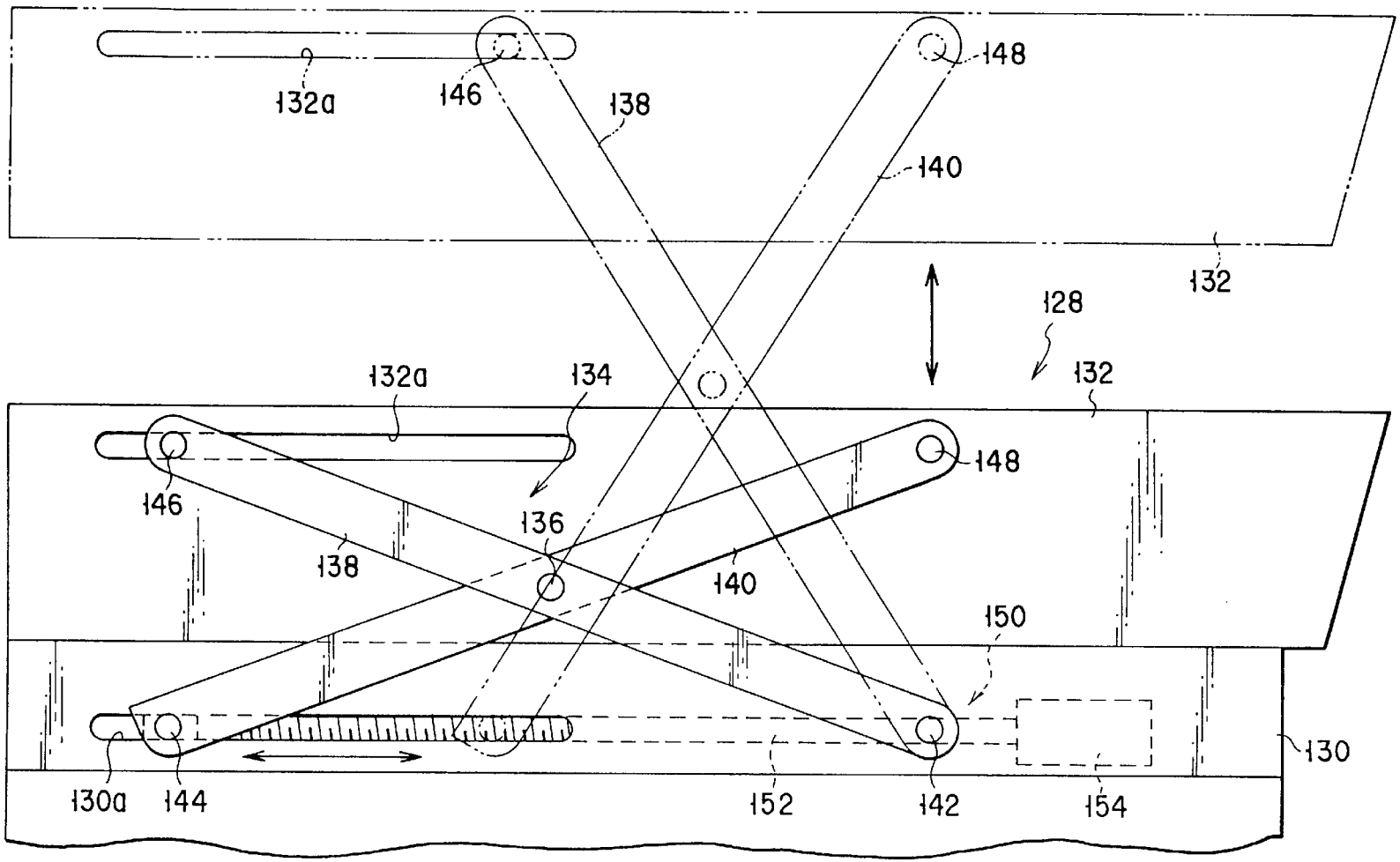
FIG. 5 is an enlarged schematic side view of a vertical traveling mechanism for a printing head protective mechanism in the ink jet printer shown in FIG. 1.

As schematically shown in a side view of FIG. 5, the vertically traveling means 128 in the embodiment comprises a stationary frame 130 anchored in the inner space of the housing 10 and a vertically movable frame 132 mounted on the stationary frame 130. The printing heads protective mechanism 126 (FIG. 1) is mounted on the upper side of the vertically movable frame 132. The stationary frame 130 and the vertically movable frame 132 are joined to each other by a known upward and downward movable parallel link mechanism 134.

The upward and downward movable parallel link mechanism 134 includes a pair of link bars 138 and 140 of substantially the same length intersecting each other at center and joined to each other by a pivot pin 136 for pivotal motion to each other. The lower end of the link bar 138 is pivotably linked by a pivot pin 142 to one side of the stationary frame 130. The lower end of the link bar 140 is joined to a horizontally movable pin 144 which is slidably fitted into a substantially horizontally extending guide slot 130*a* provided in the side of the stationary frame 130. The upper end of the link bar 138 is joined to a horizontally movable pin 146 which is slidably fitted into a substantially horizontally extending guide slot 132*a* provided in one side of the vertically movable frame 132. The upper end of the link bar 140 is pivotably linked by a pivot pin 148 to the side of the vertically movable frame 132. Also, the link bar 138 is connected at the lower end to a horizontal movement drive device 150. The horizontal movement drive device 150 in the embodiment comprises a leadscrew 152 threaded into the lower end of the link bar 140 or the horizontally movable pin 144 linked to the link bar 140, and a rotation drive device 154 such as a motor for selectively rotating the leadscrew 152 in one or opposite direction.

When the leadscrew 152 is rotated in one direction by the rotation drive device 154 with the vertically movable frame 132 located at its lowermost position denoted by the solid line in FIG. 5, the lower end of the link bar 140 moves from its left end position denoted by the solid line in FIG. 5 to its right end position denoted by the two-dot chain line. The movement of the link bar 140 causes the vertically movable frame 132 to travel in parallel from the lowermost position denoted by the solid line in FIG. 5 to the uppermost position denoted by the two-dot chain line together with the printing heads protective mechanism 126 (FIG. 1). When the leadscrew 152 is rotated in the opposite direction by the rotation drive means 154 with the vertically movable frame 132 located at its uppermost position denoted by the two-dot chain line in FIG. 5, the lower end of the link bar 140 moves from the right end position denoted by the two-dot chain line to the left end position denoted by the solid line in FIG. 5. The movement of the link bar 140 causes the vertically movable frame 132 to travel in parallel from the uppermost position denoted by the two-dot chain line 5 to the lowermost position denoted by the solid line in FIG. 5 together with the printing heads protective mechanism 126 (FIG. 1).

Figure 6:
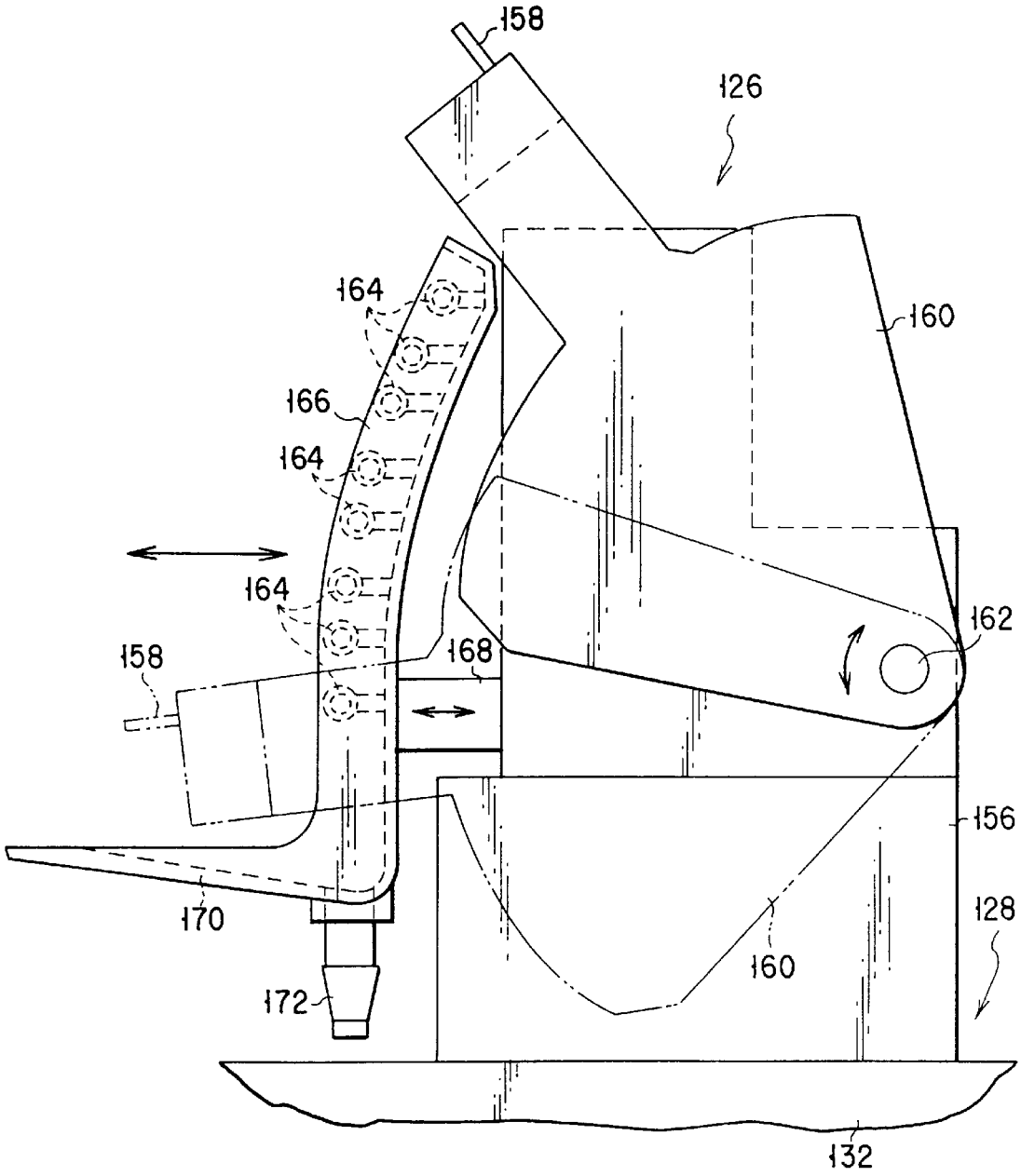
FIG. 6 is an enlarged schematic side view of the printing head protective mechanism in the ink jet printer shown in FIG. 1.

FIG. 6 illustrates an enlarged side view of the printing heads protective mechanism 126 mounted on the upper side of the vertically movable frame 132 in the vertically traveling mechanism 128. As shown in FIG. 6, the printing heads protective mechanism 126 includes a support bed 156 fixedly mounted on the upper side of the vertically movable frame 132. The support bed 156 has a swing member 160 pivotably mounted on a pivot axis 162 thereof and provided with a wiper blade 158. The swing member 160 is selectively swung by a known swing drive device, not shown, mounted in the support bed 156 to perform the upward and downward reciprocating motions of the wiper blade 158.

More specifically, the swing member 160 is located at the uppermost position denoted by the solid line in FIG. 6 when the vertically movable frame 132 of the vertically traveling mechanism 128 stays at the lowermost position denoted by the solid line in FIG. 5 (with the printing heads 102C, 102M, 102Y, and 102B of the printing equipment 64 remaining at their printing positions shown in FIG. 1). When the vertically movable frame 132 of the vertically traveling mechanism 128 is moved to the uppermost position denoted by the two-dot chain line in FIG. 5 (with the printing heads 102C, 102M, 102Y, and 102B of the printing equipment 64 shifting from the printing positions shown in FIG. 1 to the away positions not shown), the swing member 160 repeats the upward and downward reciprocating motion a given number of times between the uppermost position denoted by the solid line and the lowermost position denoted by the two-dot chain line in FIG. 6. The upward and downward reciprocating motion of the swing member 160 allows the wiper blade 158 to wipe the ink jet nozzle ends (facing the outer surface 12*a* of the rotary drum 12) of the printing heads 102C, 102M, 102Y, and 102B held at the away positions. After the number of the upward and downward reciprocating motions is completed, the swing member 160 is returned back to the uppermost position denoted by the solid line in FIG. 6.

The printing heads protective mechanism 126 also includes a cap member support frame 166 which supports a plurality of long cap members 164 extending in the same direction as of the printing heads 102C, 102M, 102Y, and 102B shown in FIG. 1. The cap member support frame 166 is mounted by a known horizontally moving mechanism 168 to the support bed 156. The long cap members 164 on the cap member support frame 166 come opposite to the ink jet nozzle ends (facing the outer surface 12*a* of the rotary drum 12) of the printing heads 102C, 102M, 102Y, and 102B at the away positions when the vertically movable frame 132 of the vertically traveling mechanism 128 is moved to the uppermost position denoted by the two-dot chain line in FIG. 5 (with the printing heads 102C, 102M, 102Y, and 102B of the printing equipment 64 shifting from the printing positions shown in FIG. 1 to the away positions not shown).

Although four of the ink jet nozzle ends of the printing heads 102C, 102M, 102Y, and 102B are illustrated in FIG. 1, the cap member support frame 166 carries eight of the cap members 164 arranged vertically at equal intervals. This is because each of the printing heads 102C, 102M, 102Y, and 102B includes two vertically spaced rows of ink jet segments aligned along the center line of rotation 14 of the rotary drum 12 (FIG. 1) as will be explained later in more detail.

After the number of the upward and downward reciprocating motions of the swing member 160 is completed, the cap member support frame 166 is horizontally moved (to the left in FIG. 6) by the known horizontally moving mechanism 168 from the backward position shown in FIG. 6 to the forward position where it faces the ink jet nozzle ends of the printing heads 102C, 102M, 102Y, and 102B, thus pressing the cap members 164 against the corresponding ink jet nozzle ends of (more precisely, the ink jet segments of) the printing heads 102C, 102M, 102Y, and 102B. The cap members 164 in the embodiment are made of an elastic material for definitely sealing the corresponding ink jet nozzle ends without giving damages. In FIG. 6, the cap members 164 has a tubular shape in cross section which is most preferable for the elastic material.

Immediately before the vertically movable frame 132 of the vertically traveling mechanism 128 shown in FIG. 5 starts moving from the uppermost position denoted by the two-dot chain line to the lowermost position denoted by the solid line of FIG. 5, the cap member support frame 166 is moved back (to the right in FIG. 6) by the known horizontally moving mechanism 168 from the forward position where the cap members 164 press against the corresponding ink jet nozzle ends of the printing heads 102C, 102M, 102Y, and 102B of the printing equipment 64 at the away positions (FIG. 1) to the backward position where the cap members 164 are spaced from the corresponding ink jet nozzle ends as shown in FIG. 6. As the cap member support frame 166 has been returned to the backward position shown in FIG. 6, the vertically movable frame 132 of the vertically traveling mechanism 128 shown in FIG. 5 travels from the uppermost position denoted by the two-dot chain line to the lowermost position denoted by the solid line in FIG. 5 together with the printing heads protective mechanism 126 and then, the printing heads 102C, 102M, 102Y, and 102B of the printing equipment 64 (FIG. 1) are moved by the radially traveling mechanism 110 (FIG. 1) from the away positions not shown to the printing positions shown in FIG. 1 for starting the printing action.

Referring to FIG. 6, an ink receiver 170 which extends in the same direction as of the printing heads 102C, 102M, 102Y, and 102B of the printing equipment 64 shown in FIG. 1 is mounted to the lower end of the cap member support frame 166. The ink receiver 170 receives drops of the ink which fall down from the ink jet nozzle ends of the printing heads 102C, 102M, 102Y, and 102B of the printing equipment 64 at the away positions due to the upward and downward reciprocating motion of the swing member 160 with the wiper blade 158 or the pressing of the cap members 164 against the corresponding ink jet nozzle ends. The ink receiver 170 can also receive drops of the ink falling from the ink jet nozzle ends of the printing heads 102C, 102M, 102Y, and 102B while the printing heads protective mechanism 126 together with the vertically movable frame 132 of the vertically traveling mechanism 128 stays at the lowermost position shown in FIG. 5 (with the printing heads 102C, 102M, 102Y, and 102B of the printing equipment 64 located at the printing positions shown in FIG. 1). There is an ink discharge pipe 172 connected to a discharged ink tank not shown in FIG. 6.

Figure 7:
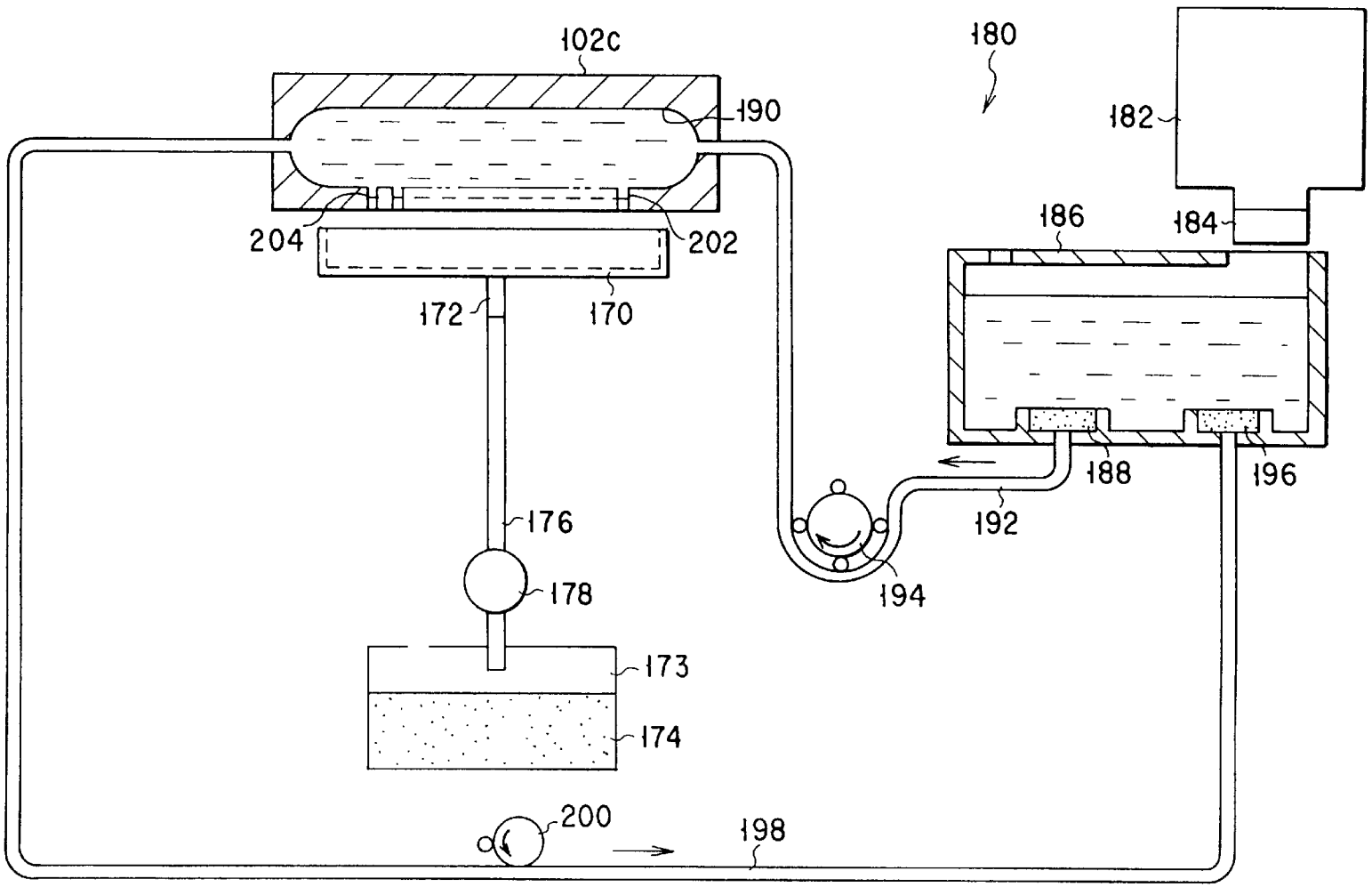
FIG. 7 is a schematic view of an ink supplying means of the printing equipment in the ink jet printer shown in FIG. 1.

FIG. 7 schematically illustrates an arrangement of an ink supplying device 180 for supplying each of the printing heads 102C, 102M, 102Y, and 102B of the printing equipment 64 shown in FIG. 1 with a flow of ink. Also shown in FIG. 7 is a discharged ink tank 173 connected to the ink discharge pipe 172 from the ink receiver 170. The discharged ink tank 173 contains an ink absorbing material 174 such as sponge and of which inlet is communicated by a discharged ink tube 176 to the ink discharge pipe 172. The discharged ink tube 176 may be equipped with an ink suction pump 178 if desired.

The printing heads 102C, 102M, 102Y, and 102B of the printing equipment 64 shown in FIG. 1 are supplied with their respective inks of different colors from the corresponding ink supplying device 180. In this embodiment, the printing heads 102C, 102M, 102Y, and 102B are supplied with a cyan color ink, a magenta color ink, a yellow color ink, and a black ink respectively. While the rotary drum 12 shown in FIG. 1 performs the specific number of rotations, a full color image can be printed on the printing medium P attached on the outer surface 12*a* of the rotary drum 12 according to an image signal supplied to the printing equipment 64.

The number of the printing heads in the printing equipment 64 is not limited to four but may be any desired number. If two printing heads for printing light red and blue are added to the printing heads 102C, 102M, 102Y, and 102B in the printing equipment 64, the quality of each full color image will be enhanced.

The ink supplying device 180 for the corresponding printing heads 102C, 102M, 102Y, and 102B are identical in the arrangement; the arrangement of the ink supplying device 180 shown in FIG. 7 is for the printing head 102C. The ink supplying device 180 comprises an ink tank 186 to which an ink cassette 182 for carrying a cyan color ink for the printing head 102C is detachably mounted by a known level maintaining device 184, an ink feed tube 192 extending from the ink tank 186 via a filter 188 to the printing head 102C and connected to an ink reservoir 190 in the ink printing head 102C, an ink pressurizing pump 194 mounted across the ink feed tube 192, an ink return tube 198 extending from the ink reservoir 190 in the printing head 102C via a filter 196 to the ink tank 186, and a tube open/close valve 200 mounted across the ink return tube 198.

The ink tanks 186 in the embodiment are opened to the atmosphere while their respective printing heads 102C, 102M, 102Y, and 102B are in use. When the ink pressurizing pump 194 is turned on with the tube open/close valve 200 being open, the cyan color ink circulates from the ink tank 186 to the ink feed tube 192, the ink reservoir 190 in the printing head 102C, and the ink return tube 198. Upon the ink open/close valve 200 being closed, the remaining of the cyan color ink in the printing head 102C is discharged from the ink jet nozzle apertures 202 by the pressure developed by the ink pressurizing pump 194 (causing a prime phenomenon). Accordingly, the ink jet nozzle apertures 202 will be bleeding and be prevented from being fouled. When the ink jet nozzle aperture 202 is accompanied with a known ink ejecting element 204 (for example, a piezoelectric device) for ejecting a jet of the cyan color ink through the ink jet nozzle aperture 202 (producing a spit effect) similar to the printing action, its bleeding and prevention from being fouled will be conducted more effectively.

After the ejection for air bleeding and prevention from being fouled is carried out, the ink pressurizing pump 194 stops and the tube open/close valve 200 is opened again. As jets of the cyan color ink have been ejected out from the ink jet nozzle apertures 202 for printing the image, the ink reservoir 190 is replenished with a fresh supply of the cyan color ink from the ink tank 186 using a capillary action in the ink return tube 198.

In this embodiment, differences between the levels of the inks in the respective ink tanks 186 for the printing heads 102C, 102M, 102Y, and 102B and the heights of the corresponding ink jet nozzle apertures 202 of the printing heads 102C, 102M, 102Y, and 102B are finely controlled depending on the types of the inks (which are different in the specific gravity, the viscosity, and other properties) so that the inks at the ink jet nozzle apertures 202 of their respective printing heads 102C, 102M, 102Y, and 102B are indented to an equal depth by the effect of surface tension (or the meniscus effect).

This allows the drops of the inks ejected from the ink jet nozzle apertures 202 of the printing heads 102C, 102M, 102Y, and 102B to be uniform in size thus increasing the quality of the image printed with the printing heads 102C, 102M, 102Y, and 102B of the printing equipment 64. For the purpose, the level of the ink in the ink tank 186 for each of the printing heads 102C, 102M, 102Y, and 102B is set lower than the height of the ink jet nozzle aperture 202 of the printing head 102C, 102M, 102Y, or 102B.

Figure 8:
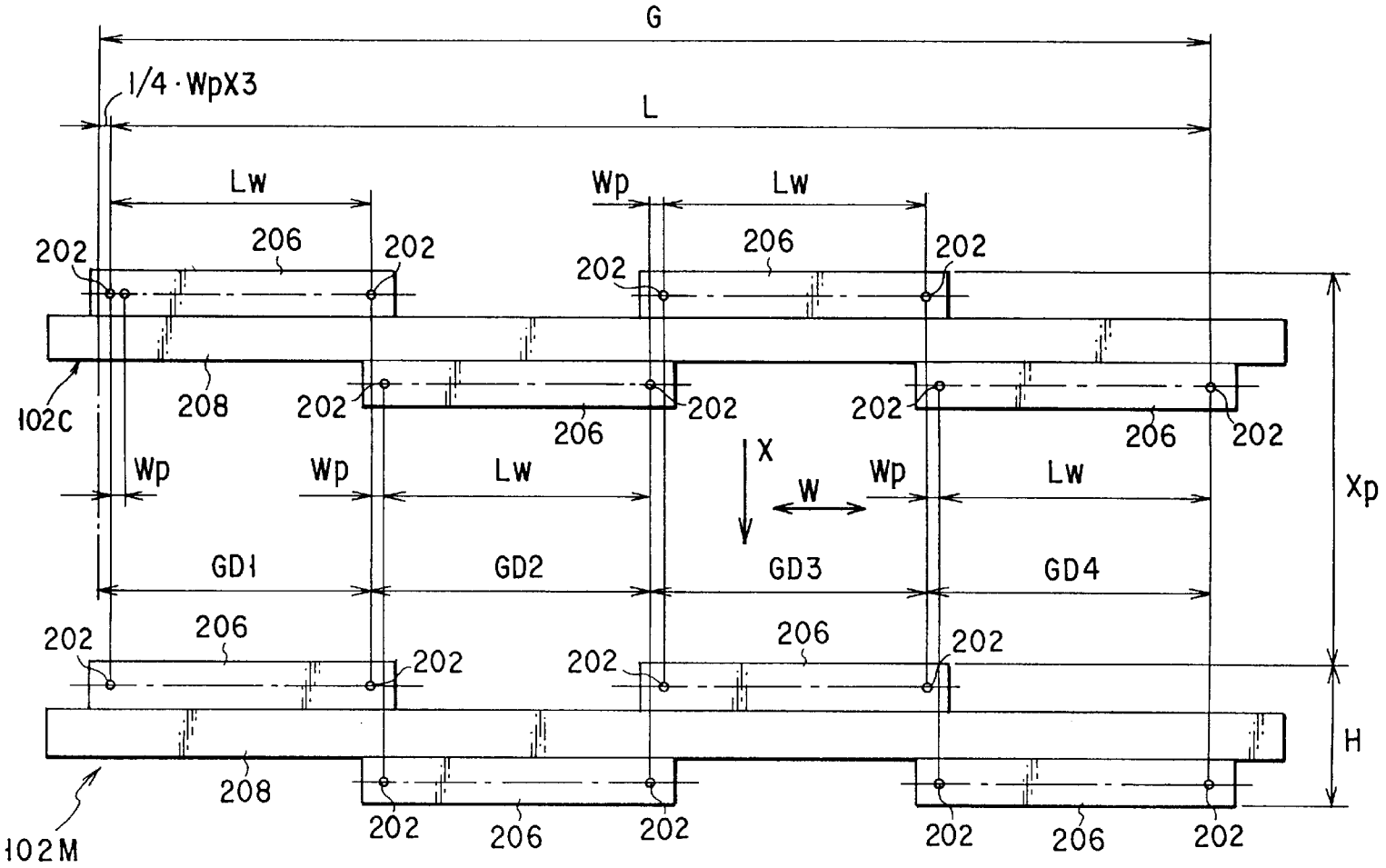
FIG. 8 is an enlarged schematic front view of two adjacent printing heads out of four printing heads of the printing equipment in the ink jet printer shown in FIG. 1.

FIG. 8 is an enlarged front view of two adjacent ones 102C and 102B of the printing heads 102C, 102M, 102Y, and 102B of the printing equipment 64 shown in FIG. 1. The printing heads 102C, 102M, 102Y, and 102B are identical in the construction.

As shown in FIG. 8, each of the printing heads 102C, 102M, 102Y, and 102B consists of two rows of the ink jet segments 206 arranged at equal intervals along the widthwise direction W in parallel to the center line 14 of rotation of the rotary drum 12 shown in FIG. 1, the two rows distanced from each other in the direction X of rotation of the rotary drum 1. More specifically, the ink jet segments 206 of each of the printing heads 102C, 102M, 102Y, and 102B are arranged in two, upstream and downstream, rows distanced from each other along the direction X of rotation. The ink jet segments 206 are aligned in the widthwise direction W in a zigzag so that each the ink jet segment 206 at the downstream row is sandwiched between the two ink jet segments 206 at the upstream row or vise versa. The ink jet segments 206 of the two, upstream and downstream, rows are alternately mounted to both sides of an ink jet segment support rod 208 which extends in the widthwise direction W.

Each of the four ink jet segments 206 shown in FIG. 8 has a number of ink jet nozzle apertures 202 provided therein at equal intervals of a pitch Wp. The distance along the widthwise direction W between the two far end ink jet nozzle apertures 202 of any two adjacent ink jet segments 206 at the two rows respectively is equal to Wp of the pitch between any two adjacent ink jet apertures 202 in one ink jet segment 206.

The ink jet nozzle apertures 202 in the corresponding ink jet segments 206 of the printing heads 102C, 102M, 102Y, and 102B are aligned one another along the direction X of rotation.

Since the ink jet segments 206 are arranged in a zigzag for each of the printing heads 102C, 102M, 102Y, and 102B, the pitch Wp between the two ink jet nozzle apertures 202 will be minimized without employing a particular technique and thus increasing the cost of production for the printing heads 102C, 102M, 102Y, and 102B of the printing equipment 64. If the cost of production is not critical or the pitch Wp between the two ink jet nozzle apertures 202 is greater than that in the embodiment, the ink jet segments 206 for each of the printing heads 102C, 102M, 102Y, and 102B may be linearly aligned along the widthwise direction W.

In this embodiment, the distance Lw between the two far end ink jet nozzle apertures 202 in the ink jet segment 206 for each of the printing heads 102C, 102M, 102Y, and 102B is 2.11 inches. Throughout the distance Lw, 159 of the ink jet nozzle apertures 202 are provided. More particularly, the pitch Wp between any two adjacent ink jet nozzle apertures 202 is 1/75 inch. The distance H between both edges of the two rows of the ink jet segments 206 is 9 mm along the direction X of rotation. The distance between the two far end ink jet nozzles apertures 202 of the two adjacent ink jet segments 206 arranged in a zigzag is also 1/75 inch equal to the pitch Wp between any two adjacent ink jet nozzle apertures 202 of each the segment 206.

Also, the distance Xp between any two adjacent ink jet segments 206 of two of the printing heads 102C, 102M, 102Y, and 102B along the direction X of rotation is 20 mm.

While the printing heads 102C, 102M, 102Y, and 102B of the printing equipment 64 is located at their printing positions as shown in FIG. 1, the ink jet nozzle ends of the ink jet segments 206 for the printing heads 102C, 102M, 102Y, and 102B are spaced by 1 mm from the outer surface 12*a* of the rotary drum 12.

The duration when one jet of the ink is applied from the corresponding ink jet nozzle aperture 202 of the ink jet segment 206 for the printing head 102C, 102M, 102Y, or 102B is 0.1 msec (for printing one dot of the image).

Figure 4:
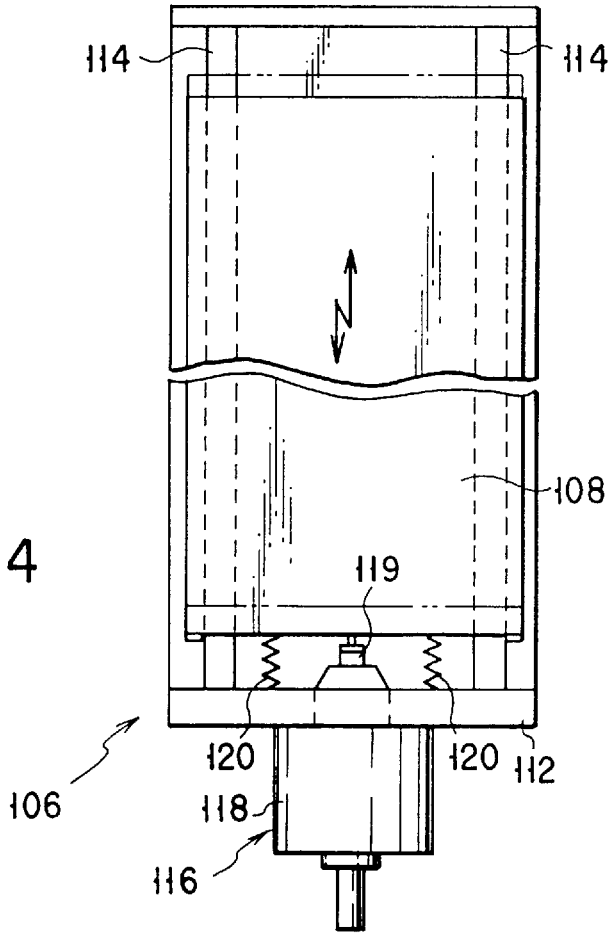
FIG. 4 is a schematic plan view of an axially traveling mechanism of a printing equipment in the ink jet printer shown in FIG. 1.
Figure 9:
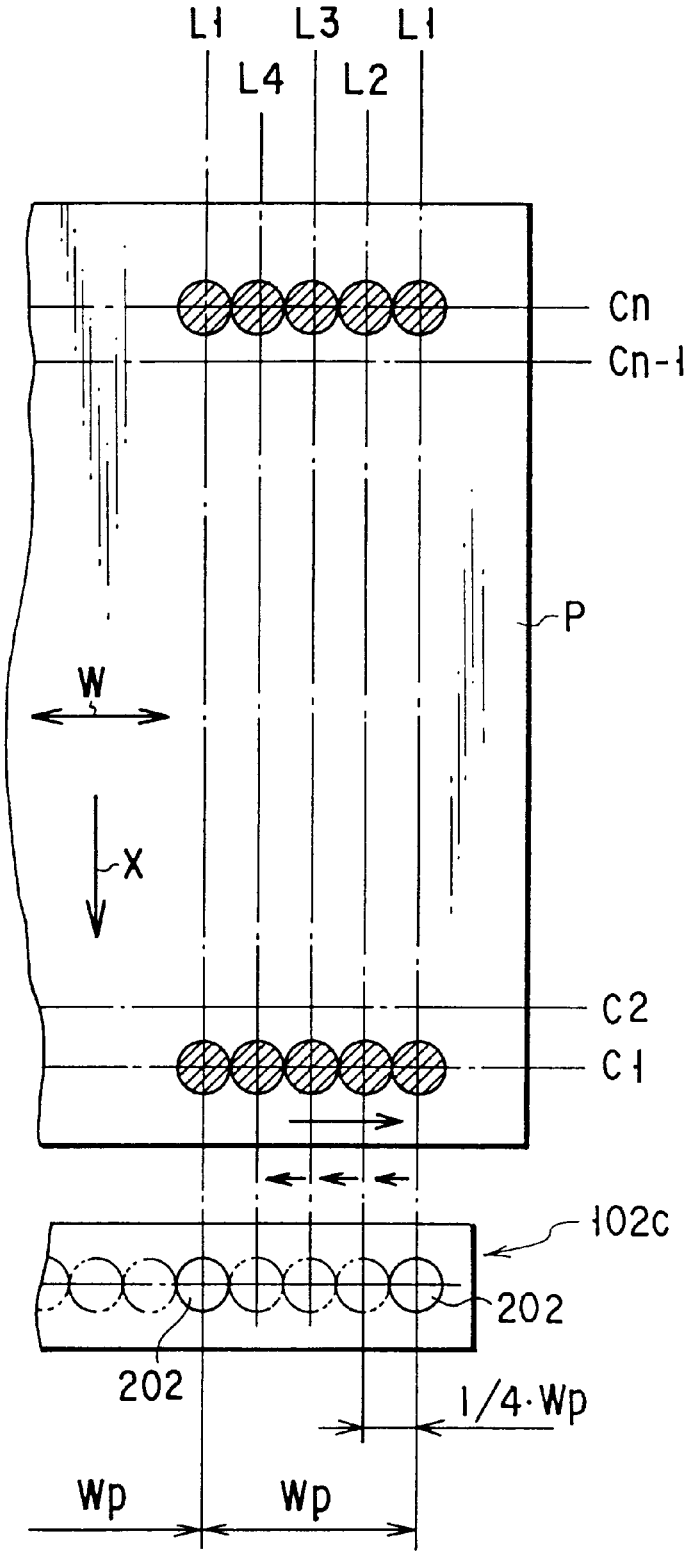
FIG. 9 is a schematic view showing an action of printing an image on the printing medium with one of the printing heads shown in FIG. 8.

FIG. 9 schematically illustrates the four printing heads 102C, 102M, 102Y, and 102B arranged as shown in FIG. 8 and the axially forward and backward traveling mechanism 106 arranged as shown in FIGS. 1 and 4 operating in a combination for printing a desired image on the printing medium P held at the specific location on the outer surface 12*a* of the rotary drum 12 during the number of rotations of the rotary drum 12 shown in FIG. 1.

More specifically, while the rotary drum 12 shown in FIG. 1 performs four full rotations, the printing heads 102C, 102M, 102Y, and 102B of the printing equipment 64 are actuated to print the desired image on the printing medium P held on the outer surface 12*a* of the rotary drum 12. As one full rotation of the rotary drum 12 shown in FIG. 1 takes 0.5 second, the image on the printing medium P will be printed in two seconds.

For locating the printing medium P to the specific location on the outer surface 12*a* of the rotary drum 12 and removing the printing medium P from the outer surface 12*a* of the rotary drum 12, the rotary drum 12 rotates two times, one for each action. Accordingly, during the period in which the printing medium P is located to the specific location on the outer surface 12*a* of the rotary drum 12, printed with a desired image, and removed from the outer surface 12*a* of the rotary drum 12, six full rotations of the rotary drum 12 is needed and takes 3 seconds. As the result, 20 full color images can be printed in one minute.

More particularly, while the rotary drum 12 shown in FIG. 1 turns one full rotation, the printing heads 102C, 102M, 102Y, and 102B are driven by the action of the axially forward and backward traveling mechanism 106 arranged as shown in FIGS. 1 and 4 to move ¼ of the pitch Wp (1/75 inch) between the ink jet nozzle apertures 202 of the ink jet segment 206 (1/75 inch×¼=1/300 inch) in the widthwise direction W (to the left in FIG. 9) along the center line 14 of rotation of the rotary drum 12. This allows the ink jet nozzle aperture 202 to eject jets of the ink in response to the image signal from the control unit 18 (FIG. 1) for printing a series of dots from C1 to Cn along the first dot column L1 during first one of the four rotations of the rotary drum 12 shown in FIG. 1. When the rotary drum 12 shown in FIG. 1 has conducted the first rotation, the printing heads 102C, 102M, 102Y, and 102B are moved ¼ Wp in the widthwise direction W (to the left in FIG. 9) by the axially forward and backward traveling mechanism 106 shown in FIGS. 1 and 4 before the rotary drum 12 starts the second rotation (more specifically before the ink jet nozzle aperture 202 departs from the last dot Cn and returns to the first dot C1). During the second rotation of the rotary drum 12 shown in FIG. 1, the ink jet nozzle aperture 202 delivers jets of the ink in response to the image signal from the control unit 18 (FIG. 1) to print a series of dots from C1 to Cn along the second column L2. This action is repeated until the rotary drum 12 shown in FIG. 1 completes the four rotations. As the result, a matrix of dots according to the image signal from the control unit 18 (FIG. 1) are printed from C1 at the first column L1 to Cn of the fourth column L4 with the jets of the ink applied from each of the ink jet nozzle apertures 202.

With the four printing heads 102C, 102M, 102Y, and 102B, the image at a resolution of 300 dpi can be printed throughout a width range G, which is a sum of the distance L between the two outermost ink jet nozzle apertures 202 of the ink jet segments 206 aligned in the widthwise direction W (FIG. 8) and the distance of three pitch movements of the ink jet nozzle apertures 202 (¼ Wp×3), on the printing medium P held at the particular location on the outer surface 12*a* of the rotary drum 12 shown in FIG. 1. In four sections GD1, GD2, GD3, and GD4 divided from the width range or image printable range G, portions of the image are printed with their respective printing heads 102C, 102M, 102Y, and 102B applying jets of the inks from the ink jet nozzle apertures 202.

When the rotary drum 12 shown in FIG. 1 has conducted four rotations to print a full color image on the printing medium P, the axially forward and backward traveling mechanism 106 shown in FIGS. 1 and 4 drives the four printing heads 102C, 102M, 102Y, and 102B to return with the ink jet nozzle apertures 202 from the final dot point at the fourth column L4 to the start dot point at the first column L1 during the fifth rotation of the rotary drum 12 for removing the printing medium P from the particular location on the outer surface 12*a* of the rotary drum 12.

The combination action of the four printing heads 102C, 102M, 102Y, and 102B and the axially forward and backward traveling mechanism 106 shown in FIGS. 1 and 4 permits the image to be printed on the printing medium P held at the particular location on the outer surface 12*a* of the rotary drum 12 at a desired degree of resolution by varying the number of rotations of the rotary drum 12 shown in FIG. 1 for printing a full color and the pitch of movement of the four printing heads 102C, 102M, 102Y, and 102B.

Figure 10:
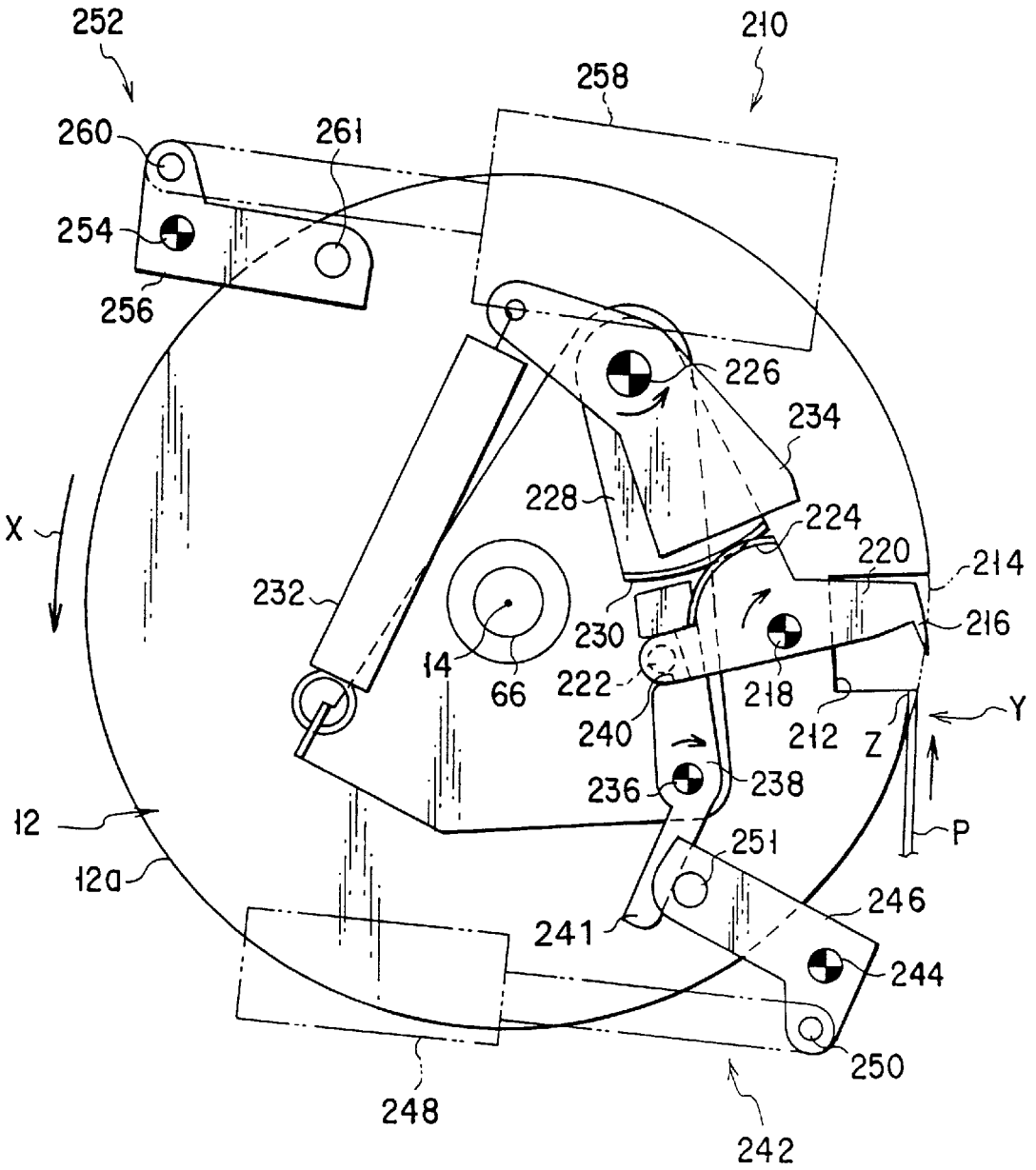
FIG. 10 is an enlarged schematic side view of a printing medium holding device for detachably holding the leading end of the printing medium onto a particular point on the outer surface of the rotary drum in the ink jet printer shown in FIG. 1, illustrating a state just before holding the leading end of the printing medium.

FIG. 10 is a side view of the printing medium holding device 210 for holding to the particular zone Z on the outer surface 12*a* of the rotary drum 12 the leading end of the printing medium P which has been fed at the same speed as of the circumferential speed of the outer surface 12*a* of the rotary drum 12 from the paired transfer rollers 30 and 32 shown in FIG. 1 to the specific location Y over the outer surface 12*a* of the rotary drum 12.

The rotary drum 12 has a recess 212 therein extending along and in parallel to the center line 14 of rotation of the rotary drum 12 which rotates in the direction X and located just before the particular zone Z on the outer surface 12*a* of the rotary drum 12. The particular zone Z comprises a band-like region at the trailing edge of the recess 212 in the outer surface 12*a* of the rotary drum 12 when the rotary drum 12 is rotated in the direction X. The rotary drum 12 is smaller in the radius at the particular zone Z than at the other outer surface 12*a*. As clearly shown, the particular zone Z is located inwardly of a trace 214 of the outer surface 12*a* which extends over the recess 212 from the leading edge to the trailing edge.

A printing medium holding hook 216 is mounted to extend across the recess 212. The printing medium holding hook 216 is integrally formed on one end of a swing member 220 which is pivotably mounted by a pivot pin 218 to the side of the rotary drum 12. As the swing member 220 moves on the pivot, the printing medium holding hook 216 is shifted in a direction opposite to the direction X from the release position spaced forwardly of the direction X from the particular zone Z on the outer surface 12*a* of the rotary drum 12 to the overlap position where the hook 216 comes over the particular zone Z. The other end of the swing member 220 is provided with an engaging pin 222 and a fan-shaped gear sector 224 arranged coaxially of the pivot pin 218.

Also, a sub swing member 228 is pivotably mounted by a pivot pin 226 to the side of the rotary drum 12. The sub swing member 228 is provided at one end with a fan-like gear sector 230 arranged coaxially of the pivot pin 226. The fan-shaped gear sector 230 of the sub swing member 228 is engaged with the fan-shaped gear sector 224 of the swing member 220. The other end of the sub swing member 228 is joined to an urging member 232 which is mounted to the side of the rotary drum 12. By the action of the urging member 232, the printing medium holding hook 216 is urged from the release position, spaced forwardly of the direction X from the particular zone Z on the upper surface 12*a* shown in FIG. 10, towards the overlap position through the engagement between the fan-shaped gear sector 230 of the sub swing member 228 and the fan-shaped gear sector 224 of the swing member 220. The urging member 232 in the embodiment is a tension coil spring.

A cam 234 extending radially of the rotary drum 12 is outwardly mounted to one side of the sub swing member 228.

Also, an engaging lever 238 is pivotably mounted by a pivot pin 236 to the side of the rotary drum 12 as located opposite to the sub swing member 228 about the swing member 220. The engaging lever 238 has an engaging recess 240 provided in one end thereof for engagement with the engaging pin 222 of the swing member 220.

When the printing medium holding hook 216 is at the release position for not holding the leading end of the printing medium P as shown in FIG. 10, the engaging lever 238 is located with its engaging recess 240 engaging the engaging pin 222 of the swing member 220 thus locking the printing medium holding hook 216 to the release position shown in FIG. 10 while resisting against the force of the urging member 232. In other words, the engaging pin 222 of the swing member 220 and the engaging recess 240 of the engaging lever 238 constitute in a combination a release position locking mechanism for locking the printing medium holding hook 216 to the release position.

The engaging lever 238 is also urged to the engaging point by an urging member not shown. The distal end of the printing medium holding hook 216 is situated more outward in the radial direction of the rotary drum 12 at the rearward end in the direction X than at the forward end.

The other end of the engaging lever 238 extends outwardly in the radial direction of the rotary drum 12 thus forming a cam 241.

A lock release mechanism 242 is mounted on the side of the rotary drum 12 for selectively releasing the engagement of the engaging lever 238 just before the printing medium P arrives at the specific location Y over the outer surface 12*a* of the rotary drum 12 which rotates in the direction X. The lock release mechanism 242 comprises a drive lever 246 pivotably mounted by a pivot pin 244 to the housing 10 (FIG. 1) adjacent to the specific location Y and near the side of the rotary drum 12 and a known actuator 248 mounted to the housing 10 (FIG. 1) adjacent to the specific location Y and near the side of the rotary drum 12. The actuator 248 is linked by a link pin 250 to one end of the drive lever 246. The actuator 248 selectively drives the end of the drive lever 246 so that the other end of the drive lever 246 moves between the operating position where it extends and engages with the cam 241 of the engaging lever 238 being turned by the rotation of the rotary drum 12 as shown in FIG. 10 and the rest position which is away from the turning motion of the cam 241. The other end of the drive lever 246 is provided with an engaging pin 251.

Figure 11:
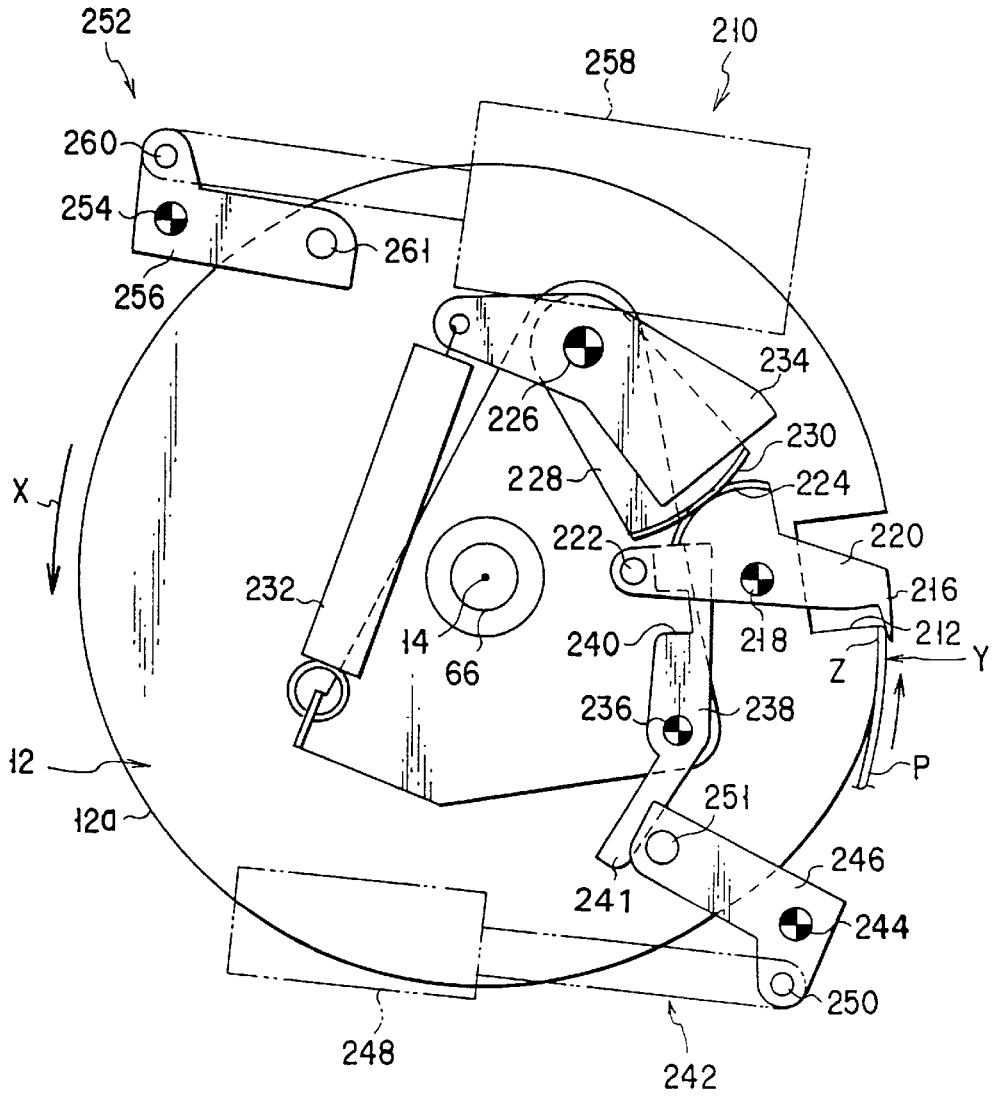
FIG. 11 is an enlarged schematic side view of the printing medium holding device shown in FIG. 10, illustrating a state after holding the leading end of the printing medium.

Moreover, a lock reset mechanism 252 is mounted to the side of the rotary drum 12 for selectively driving the cam 234 joined to the sub swing member 228 to reset the engagement of the engaging lever 238 before reaching at the removing device 62 shown in FIG. 1 when the rotary drum 12 rotates in the direction X. The lock reset mechanism 252 is similar in the construction to the lock release mechanism 242 and comprises a drive lever 256 pivotably mounted by a pivot pin 254 to the housing 10 (FIG. 1) adjacent to the removing device 62 shown in FIG. 1 and near the side of the rotary drum 12 and a known actuator 248 mounted to the housing 10 (FIG. 1) adjacent to the removing device 62 and near the side of the rotary drum 12. The actuator 258 is linked by a link pin 260 to one end of the drive lever 256. The actuator 258 selectively drives the end of the drive lever 256 so that the other end of the drive lever 256 moves between the operating position where it extends and engages with the cam 234 located at its radially outward position with the sub swing member 228 being turned by the rotation of the rotary drum 12 as shown in FIG. 11 and the rest position which is away from the cam 234 located at its inward position as shown in FIG. 10. The other end of the drive lever 256 is provided with an engaging pin 261.

The actuator 248 of the lock release mechanism 242 drives the drive lever 246 to move to the operating position shown in FIG. 10 before the printing medium holding hook 216 comes to the specific location Y over the outer surface 12*a* of the rotary drum 12 as shown in FIG. 10. With the drive lever 246 at the operating position, the engaging pin 251 on the other end of the drive lever 246 strikes the cam 241 thus turning the engaging lever 238 about the pivot pin 236 in the release direction (clockwisely in FIG. 10) while resisting against the force of the urging member not shown. Accordingly, the swing member 220 is urged by the yielding force of the urging means 232 to move from the release position shown in FIG. 10 to the close position.

In synchronized with the striking the cam, the printing medium P is fed at the same speed as of the circumferential speed of the outer surface 12*a* of the rotary drum 12 from the paired transfer rollers 30 and 32 to the specific location Y. Then, the leading end of the printing medium P is pressed against the particular zone Z on the outer surface 12*a* of the rotary drum 12 by the printing medium holding hook 216 at the close position and is held between the particular zone Z and the printing medium holding hook 216 as shown in FIG. 11.

As the rotation of the rotary drum 12 starts, the drive lever 246 is moved backward by the actuator 248 from the operating position shown in FIGS. 10 and 11 to the rest position not shown with the printing medium P held by suction to the outer surface 12*a* of the rotary drum 12. This is followed by the number of rotations (four rotations in this embodiment) of the rotary drum 12 required for printing a desired image with the printing equipment 64 shown in FIG. 1.

Figure 12:
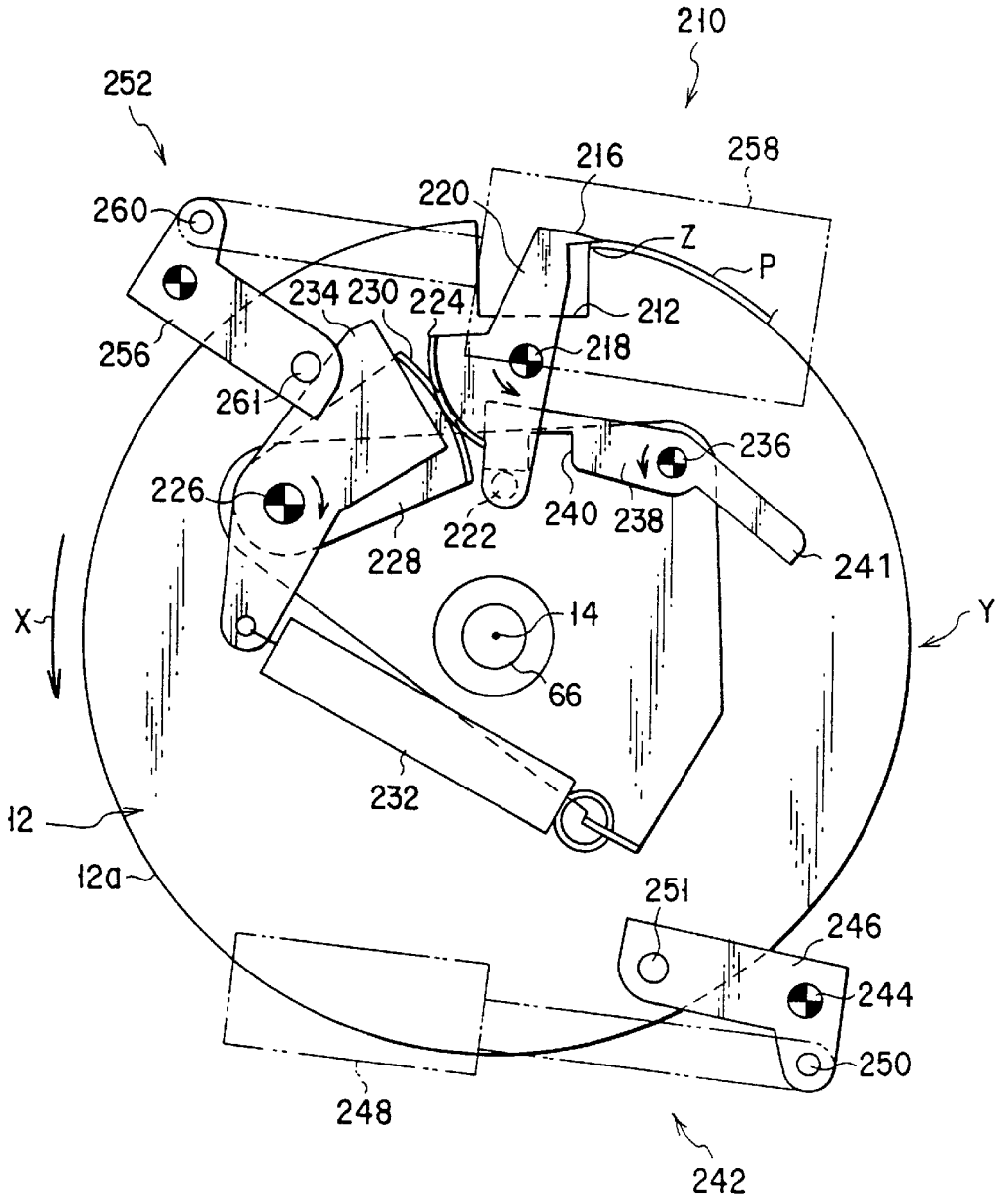
FIG. 12 is an enlarged schematic side view of the printing medium holding device shown in FIG. 10, illustrating a state just before releasing the leading end of the printing medium.

As the rotary drum 12 continues to rotate after the number of rotations, the actuator 258 of the lock reset mechanism 252 drives the drive lever 256 to move forward from the rest position shown in FIGS. 10 and 11 to the operating position shown in FIG. 12 before the printing medium holding hook 216 arrives at the removing device 62 shown in FIG. 1. Then, the cam 234 of the sub swing member 228 which holds the printing medium holding hook 216 to the overlap position strikes the engaging pin 261 on the other end of the drive lever 256 at the operating position. This allows the sub swing member 228 to turn (clockwisely in FIG. 12) from the outward position shown in FIG. 12 to the inward position shown in FIGS. 10 and 11 as resisting against the force of the urging member 232, hence shifting the printing medium holding hook 216 from the close position to the open position. The engaging pin 222 of the swing member 220 having the printing medium holding hook 216 is then engaged with the engaging recess 240 provided in the engaging lever 238 urged by the urging member not shown. Finally, the printing medium holding hook 216 is locked to the open position while resisting against the force of the urging member 232.

As the rotary drum 12 further rotates, the printing medium P held at the particular zone on the outer surface 12*a* of the rotary drum 12 is removed by the removing device 62 from the particular zone shown in FIG. 1. To print the image on the succeeding printing medium P, the rotary drum 12 starts again the foregoing procedure described in detail referring to FIGS. 10 and 11.

Modification

Figure 13A:
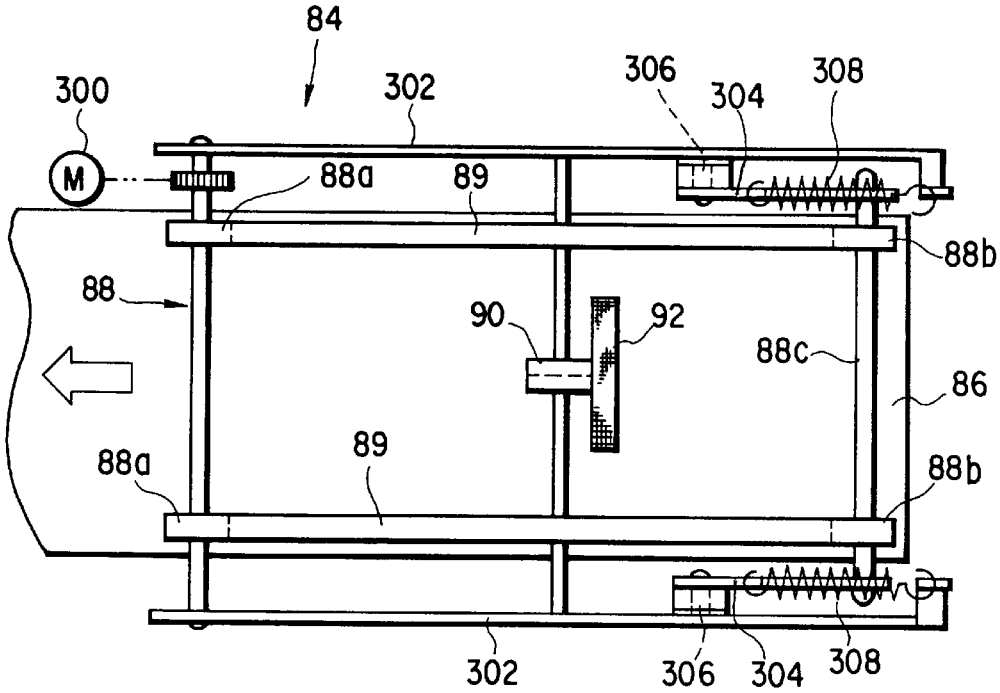
FIG. 13A is a schematic plan view of a modification of the printing medium discharge apparatus shown in FIGS. 3A, 3B and 3C.
Figure 13B:
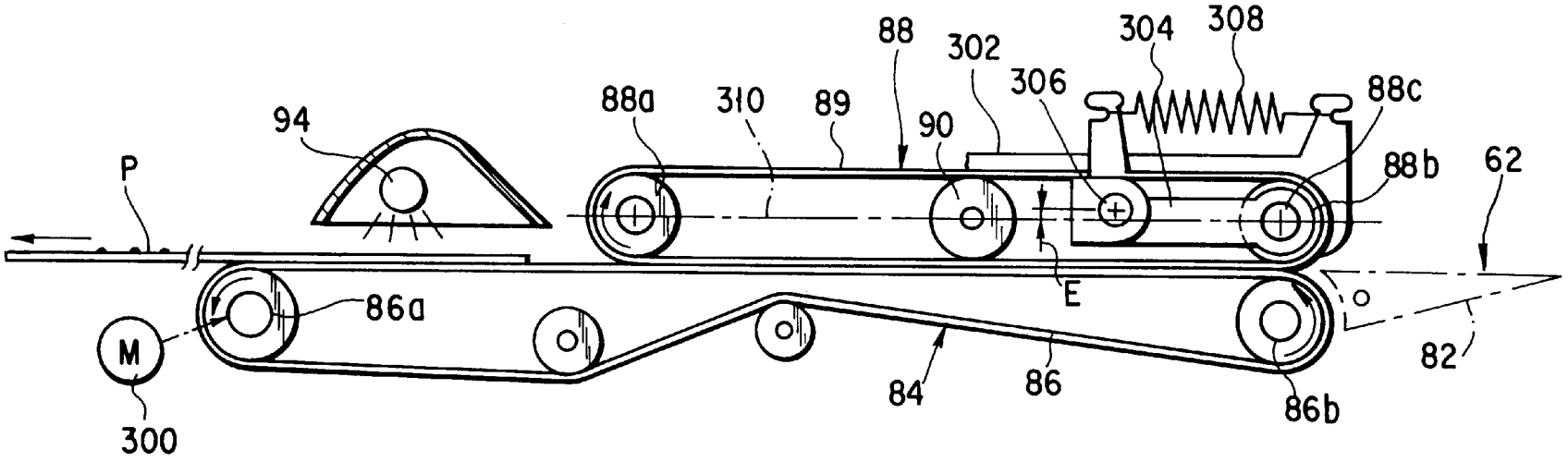
FIG. 13B is a schematic side view of the modification of the printing medium discharge apparatus of FIG. 13A.

FIG. 13A is a plan view schematically showing a modification of a printing medium discharge apparatus 84 according to a preferred embodiment of the present invention, and FIG. 13B is a side view schematically showing the modification of the printing medium discharge apparatus 84 shown in FIG. 13.

Note that those components of this modification which are the same as those of the preferred embodiment of the present invention will be referred to by the same reference numerals as specifying corresponding components of the printing medium discharge apparatus 84 according to the preferred embodiment of the present invention described before.

As is shown in FIG. 13B, in the belt conveyor of a printing medium carry and discharge device of the printing medium discharge apparatus 84 according to this modification, a rotation torque is transmitted to a belt support roller 86*a* supporting an endless belt from a known rotation drive source 300 through a known drive force transmission not shown in the figure. The belt support roller 86*b* supporting the endless belt at a rear end portion in the printing medium discharge direction described above is rotatably supported by a support frame of the housing 10 not shown in the figure.

As shown in FIGS. 13A and 13B, in the printing medium press device 88 of the printing medium discharge apparatus 84 of the modification, a rotation torque is also transmitted from the known rotation drive source 300 through a known drive force transmission to a belt support roller 88*a* supporting a pair of belt units 89 at a front end portion in the direction in which printing medium P are discharged by the printing medium carry and discharge device 86.

FIG. 13A shows a support frame 302 in the housing 10 shown in FIG. 1 which rotatably supports the rotation center shaft of the belt support roller 88*a* and the rotation center shaft of the press roller 90.

In the printing medium press device 88 of the printing medium discharge apparatus 84 according to the first modification, both end portions of the rotation center shaft 88*c* of the belt support roller 88*b* supporting the pair of belt units 89 at a rear end portion in the direction in which printing medium P is discharged by the printing medium carry and discharge device 86 are rotatably supported by a pair of swing levers 304, respectively, which are supported by the support frame 302 such that the swing levers 304 can swing. As is apparent from FIG. 13B, each of the pair of swing levers 304 has a substantially L-shaped side surface and has a horizontal arm portion projecting in a substantially horizontal direction along the upper surface of the belt of the belt conveyer of the printing medium carry and discharge device 86 positioned below the printing medium press device 88 and an upward projecting arm portion projecting upwards from a rear end (e.g., the left end in FIG. 13A) of the horizontal arm portion in the discharge direction of the printing medium P carried on the upper surface of the belt.

Each of the pair of swing levers 304 is supported on the support frame 302 by a swing center pin 306 at a rear end of the horizontal portion such that the levers can swing freely, and a front end (e.g., the right end in FIG. 13A) of the horizontal arm portion supports a corresponding end portion of the rotation center shaft 88*c* of the belt support roller 88*b*. An urging member 308 is interposed between an upper end of the upper projecting arm portion of each of the pair of swing levers 304 and a rear end portion of the support frame 302. The urging member 308 includes a tension coil spring in this modification and urges (or presses) the belt support roller 88*b* at the rear end portion of the horizontal arm portion against the upper surface of the belt of the belt conveyer of the printing medium carry and discharge device 86 positioned below the printing medium press device 88. In addition, the swing centers of the swing center pins 306 of the pair of swing levers 304 are positioned to be higher by a distance E than a line 310 connecting the rotation center line of the front and rear belt support rollers 88 for the pair of belt units 89 of the printing medium press device 88 and the rotation center line of the belt support roller 88*b*.

In the modification as constructed above, even when printing medium P removed from the outer circumferential surface 12*a* of the rotary drum 12 shown in FIG. 1 by the peel-off finger 82 of the removing device 62 and introduced to the printing medium discharge apparatus 84 have variations in thickness or are introduced at a higher speed than in a conventional apparatus, the printing medium press device 88 together with the printing medium carry and discharge device 86 is capable of securely clamp the printing medium P so that the printing medium discharge apparatus 84 can securely discharge the printing medium P at a higher speed than a conventional apparatus.

In a case where the belt conveyor of the printing medium carry and discharge device 86 is driven by the belt support roller 86*a* at the front end, the belt tends to float up on the belt support roller 86*b* at the rear end portion as the belt moving speed increases to be higher. The printing medium press device 88 urged by the urging member 308 of the modification prevents such a tendency and ensures that the printing medium discharge apparatus 84 securely discharges the printing medium P at a higher speed than a conventional apparatus.

Modification

In the preferred embodiment as described before, the printing medium discharge apparatus 84 can be pre-heated by the ink dryer device 94 before the front end of the printing medium P introduced into the printing medium discharge apparatus 84 from the outer surface 12*a* of the rotary drum 12 shown in FIG. 1 reaches the ink dryer device 94 combined with the printing medium discharge apparatus 84 in order that ink on the image formation region in the image formation surface of the printing medium P can be securely and sufficiently dried even when the printing medium P on which the image has been printed at a higher speed than the conventional apparatus.

In this modification, operation of the ink dryer device 94 is controlled such that the portion of the belt of the belt conveyor of the printing medium carry and discharge device 86 of the printing medium discharge apparatus 84 which has reached an entrance of the printing medium discharge apparatus 84 has already heated when the front end of the printing medium P from the outer surface 12*a* of the rotary drum 12 reaches the entrance of the printing medium discharge apparatus 84.

Figure 14A:
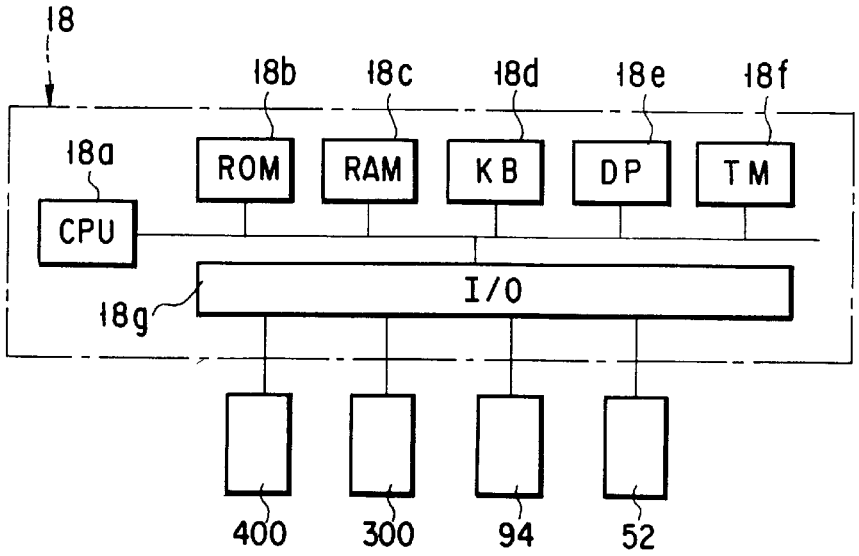
FIG. 14A is a block diagram of a controller unit for controlling an operation of a modification of an ink drying device used in conjunction with the printing medium discharge apparatus shown in FIGS. 3A, 3B and 3C.
Figure 14B:
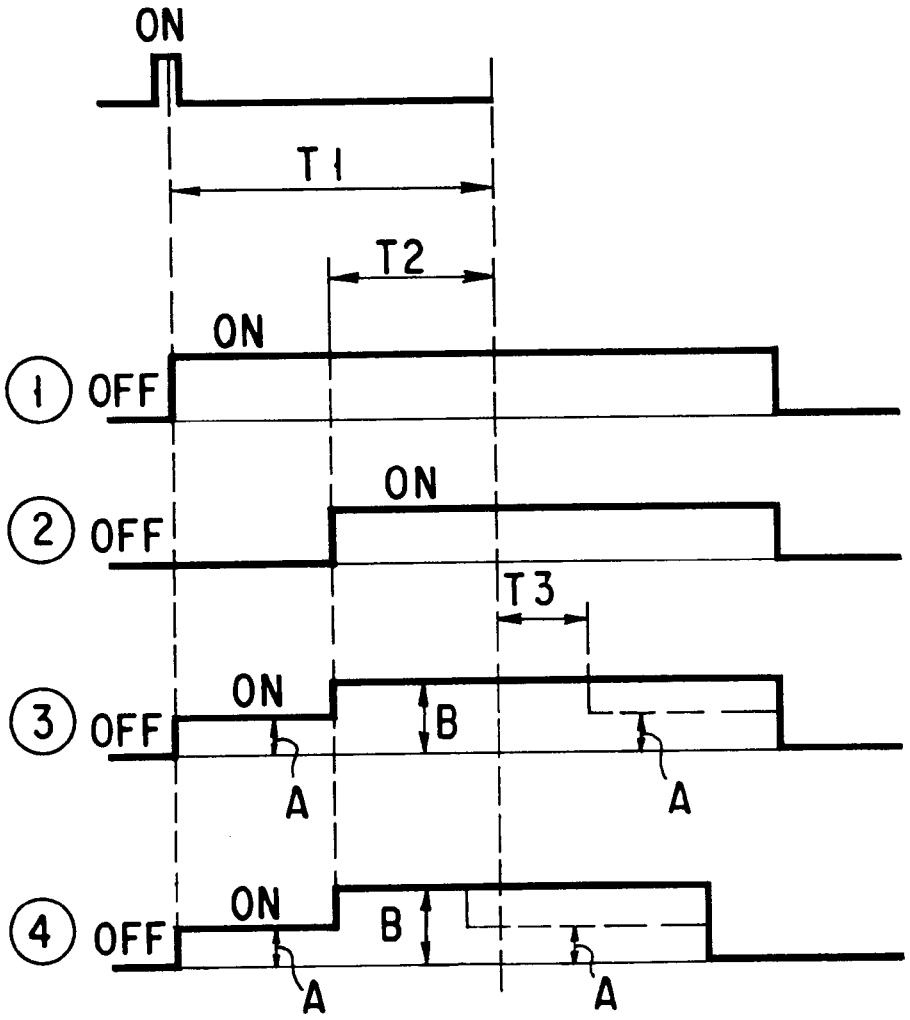
FIG. 14B is a timing chart of the operation of the modification of the ink drying device used in conjunction with the printing medium discharge apparatus shown in FIGS. 3A, 3B and 3C.

FIG. 14A shows a block diagram for such control of operation of the ink dryer device 94. FIG. 14B schematically shows a timing chart for such control of operation.

From FIG. 14A, it is known that the controller unit 18 shown in FIG. 1 comprises a CPU 18*a*, a ROM 18*b*, a RAM 18*c*, a key-board (KB) 18*d*, a display (DP) 18*e*, a timer (TM) 18*f*, and an input/output port (I/O) 18*g* which are connected with each other.

Further, the input/output port (I/O) is connected with a motor 400 for rotating the rotary drum 12, a motor 300 for rotation of the printing medium carry and discharge device 86 and the printing medium press 88 (shown in FIGS. 13A and 13B), the ink dryer device 94 (shown in FIGS. 1 and 13B), and the detecting device 52 (shown in FIGS. 1 and 2) for detecting the printing medium holding hook of the rotary drum 12.

In FIG. 14B, T1 represents a time from when the printing medium holding hook detecting device 52 detects (ON) the printing medium holding hook on the outer circumferential surface 12*a* of the rotary drum 12 to when holding of the printing medium by the printing medium holding hook is released during the same turn of the rotary drum 12 and the printing medium reaches the entrance of the printing medium discharge apparatus 84 (which is adjacent to the printing medium peel-off finger 82 of the printing medium removing device 62).

In FIG. 14B, T2 represents a time required for moving a specific portion of the belt of the belt conveyor of the printing medium carry and discharge device 86 of the printing medium discharge apparatus 84 shown in FIG. 13B from an exit of the ink dryer device 94 to the entrance of the printing medium discharge apparatus 84.

Further, in FIG. 14B, T3 represents a time required for moving the specific portion of the belt of the belt conveyor from the entrance of the printing medium discharge apparatus 84 to the entrance of the ink dryer device 94.

In this modification, the controller unit 18 turns on the switch of the ink dryer device 94 at the same time when the printing medium holding hook detecting device 52 detects (ON) the printing medium holding hook on the outer circumferential surface 12*a* of the rotary drum 12, as indicated at ① in the timing chart of FIG. 14B. Further, the switch of the ink dryer device 94 is turned off sufficiently after the specific portion of the belt of the belt conveyor of the printing medium carry and discharge device 86 has passed through the entrance of the ink dryer device 94 (e.g., when the rear end of the printing medium P with its front end set on the specific portion on the upper surface of the belt of the belt conveyer of the printing medium carry and discharge device 86 reaches the exit of the ink dryer device 94).

Therefore, when the front end of the printing medium P on which the image has been printed reaches the entrance of the printing medium discharge apparatus 84 from the outer circumferential surface 12*a* of the rotary drum 12 (shown in FIG. 1), the specific portion of the belt of the belt conveyor of the printing medium carry and discharge device 86 of the printing medium discharge apparatus 84 which reaches the entrance at the same time has already been sufficiently heated by the ink dryer device 94 from the upstream side of the specific portion. Therefore, with respect to the printing medium P introduced into the printing medium discharge apparatus 84 at the entrance, on which the image has been printed, drying of ink on the image formation region of the image formation surface is started before the medium P reaches the entrance of the ink dryer device 94. Drying of the ink on the printing medium P on which the image has been printed is kept being carried out for a relatively long time until the rear end of the printing medium P reaches the exit of the ink dryer device 94. This ensures that drying of ink on the printing medium P on which the image has been printed is securely carried out regardless of an increase of the discharge speed of the printing medium P discharged by the printing medium discharge apparatus 84.

As indicated at ② in the timing chart of FIG. 14B, the switch of the ink dryer device 94 can be turned on at the time when the specific portion of the belt of the belt conveyor of the printing medium carry and discharge device 86 of the printing medium discharge apparatus 84 reaches the exit of the ink dryer device 94 even after the printing medium holding hook detecting device 52 detects (ON) the printing medium holding hook on the outer circumferential surface 12*a* of the rotary drum 12. In this case, at the same time when the front end of the printing medium P on which the image has been printed reaches the entrance of the printing medium discharge apparatus 84, the specific portion of the belt of the belt conveyor of the printing medium carry and discharge device 86 heated by the ink dryer device 94 reaches the entrance. It is possible to save more energy generated by the ink dryer device 94 at to the timing ② of the timing chart than at the timing ①.

According to the timing ② of the timing chart, the switch of the ink dryer device 94 is turned off sufficiently after the specific portion of the belt of the belt conveyor of the printing medium carry and discharge device 86 has passed through the entrance of the ink dryer device 94 (e.g., when the rear end of the printing medium P with its front end set on the specific portion on the upper surface of the belt of the belt conveyor of the printing medium carry and discharge device 86 reaches the exit of the ink dryer device 94), like in the case of the timing ① of the timing chart as described before.

The timing ③ of the timing chart of FIG. 14B shows an example in which the switch of the ink dryer device 94 is switched into two steps of high and low levels. Specifically, at the same time when the printing medium holding hook detecting device 52 detects (ON) the printing medium holding hook on the outer circumferential surface 12*a* of the rotary drum 12, the switch of the ink dryer device 94 is turned on and switched to the low level A, and subsequently, the switch of the ink dryer device 94 is switched to the high level B at the time when the specific portion of the belt of the belt conveyor of the printing medium carry and discharge device 86 of the printing medium discharge apparatus 84 reaches the exit of the ink dryer device 94. Note that the ink dryer device 94 is set to a higher temperature when the switch of the ink dryer device 94 is switched to the high level B than when the switch is switched to the low level A. Further, the switch of the ink dryer device 94 once switched to the high level B is turned off sufficiently after the specific portion of the belt of the belt conveyor of the printing medium carry and discharge device 86 has passed through the entrance of the ink dryer device 94 (e.g., when the rear end of the printing medium P with its front end set on the specific portion on the upper surface of the belt of the belt conveyor of the printing medium carry and discharge device 86 reaches the exit of the ink dryer device 9), like at timings ① and ② of the timing chart.

The timing ③ of the timing chart further suggests that the switch of the ink dryer device 94 switched to the high level B is changed to the low level A at the time of an elapse of the time T3 required for the specific portion on the belt of the belt conveyor of the printing medium carry and discharge device 86 together with the front end of the printing medium P on which the image has been printed to reach the entrance of the ink dryer device 94 from the entrance of the printing medium discharge apparatus 84, and that the switch of the ink dryer device 94 switched to the low level A is turned off sufficiently after the specific portion of the belt of the belt conveyor of the printing medium carry and discharge device 86 has passed through the entrance of the ink dryer device 94 (e.g., when the rear end of the printing medium P with its front end set on the specific portion on the upper surface of the belt of the belt conveyor of the printing medium carry and discharge device 86 reaches the exit of the ink dryer device 9).

As a result of this, it is possible to securely dry ink while more lowering the energy required for drying ink.

The timing ④ of the timing chart suggests that the timing at which the switch of the ink dryer device 94 once changed to the high level B as indicated by ③ in the timing chart is returned to the low level A can be set to be before the time point when the specific portion on the belt of the belt conveyor of the printing medium carry and discharge device 86 together with the front end portion of the printing medium P on which the image has been printed simultaneously reaches the entrance in order to much more lowering the energy required for drying ink as long as secure drying of ink is ensured.

Modification

In another modification of the printing medium discharge apparatus 84, operation of the printing medium discharge apparatus 84 can be controlled in a manner as described below. Specifically, the printing medium discharge apparatus 84 of this another modification discharges the printing medium P on which an image has been printed, at a speed equal to the circumferential speed of the outer circumferential surface 12*a* of the rotary drum 12 until the rear end of the printing medium P from the rotary drum 12 shown in FIG. 1 is separated from the rotary drum 12, and further discharges the printing medium P at a speed lower than the circumferential speed of the outer circumferential surface 12*a* of the rotary drum 12 until a next printing medium on which an image has been printed is introduced into the printing medium carry and discharge device after the rear end of the printing medium P from the rotary drum 12 is separated from the rotary drum 12.

Figure 15A:
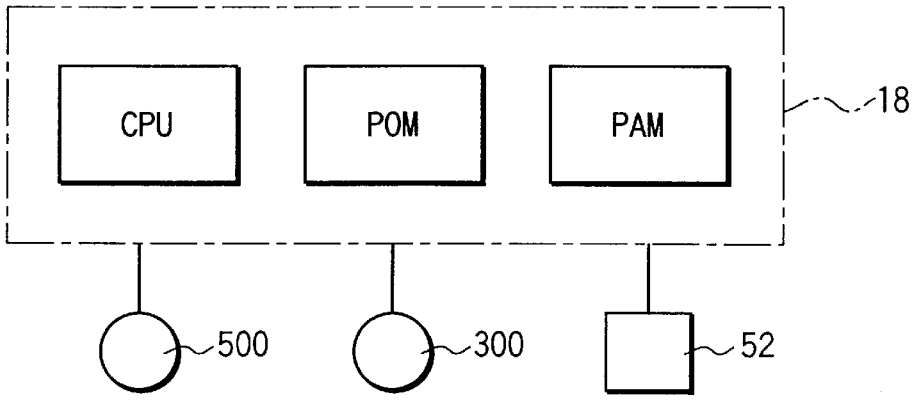
FIG. 15A is a block diagram of a controller unit for controlling an operation of a further modification of the printing medium discharge apparatus shown in FIGS. 3A, 3B and 3C.
Figure 15B:
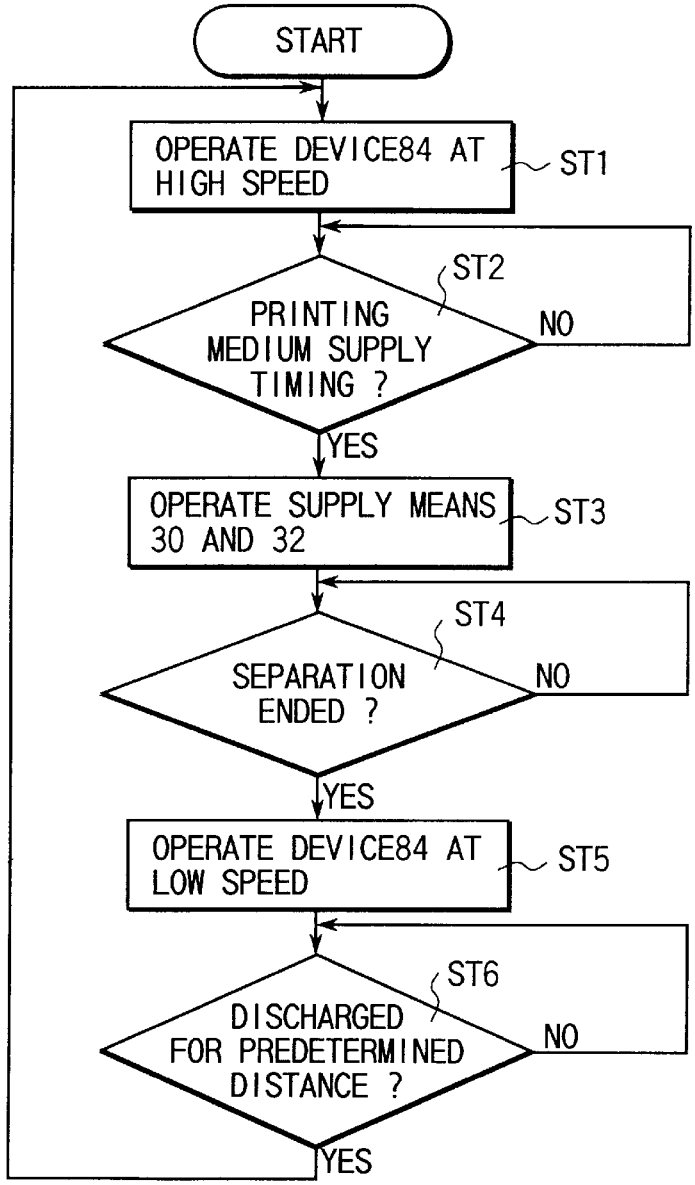
FIG. 15B is a flow chart schematically showing a flow of the operation of the further modification of the printing medium discharge apparatus shown in FIGS. 3A, 3B and 3C.

FIG. 15A shows a schematic block diagram of the controller unit 18 for controlling operation of this another modification of the printing medium discharge apparatus 84 shown in FIGS. 3A, 3B, and 3C. FIG. 15B shows a schematic flow of the operation of this another modification of the printing medium discharge apparatus shown in FIGS. 3A, 3B, and 3C.

As can be seen from FIG. 15A, the controller unit 18 for controlling operation of the modification comprises a CPU, a ROM, and a RAM, and is connected with a motor 500 as a rotation drive source for a pair of transfer rollers 30 and 32 shown in FIG. 1, the motor 300 as a rotation drive source for the printing medium discharge apparatus 84 shown in FIGS. 13A and 13B, and the known detecting device 52 for detecting a predetermined rotation angle position for releasing the printing medium holding device of the rotary drum 12 described before and shown in FIG. 1.

FIG. 15B shows that the printing medium discharge apparatus 84 shown in FIG. 1 is operated at the same speed as a predetermined circumferential speed of the outer circumferential surface 12*a* of the rotary drum 12 (ST1). The pair of transfer rollers 30 and 32 of the printing medium feeding device 28 supply the printing medium P at a predetermined timing (ST2) toward the outer circumferential surface 12*a* of the rotary drum 12 rotating at the predetermined speed in the predetermined direction X (ST3). As a result of this, the printing medium P from the pair of transfer rollers 30 and 32 is held at the predetermined position (by the printing medium holding device) on the outer circumferential surface 12*a* of the rotary drum 12 with the front end of the printing medium P situated at the predetermined position Y around the outer circumferential surface 12*a* of the rotary drum 12. While the rotary drum 12 rotates by the predetermined number of rotations after the printing medium P is held on the outer circumferential surface 12*a* of the rotary drum 12 and is suctioned by the suction force of the charge, the printing equipment 64 performs printing of a predetermined image onto the printing medium P. After rotation of the rotary drum 12 for a predetermined number of rotations is completed for printing, the printing medium holding device releases holding of the front end of the printing medium P, and simultaneously, the removing device 62 removes the printing medium P on which an image has been printed from the outer circumferential surface of the rotary drum 12 (ST4). Until a time required for the rear end of the printing medium P on which an image has been printed the removing device 62 to be separated from the outer circumferential surface of the rotary drum 12 after the removing device 62 is operated, the printing medium discharge apparatus 84 is operated at the same speed (or high speed) as the predetermined circumferential speed of the outer circumferential surface 12*a* of the rotary drum 12. After the predetermined time described above is elapsed, the printing medium discharge apparatus 84 is operated at a lower speed (or low speed) than the predetermined circumferential speed of the outer circumferential surface 12*a* of the rotary drum 12 (ST5). This operation is carried out in order to sufficiently dry ink in the image formation region on the image formation surface of the printing medium P. After the printing medium P on which an image has been printed is discharged by a predetermined distance at a low speed by the printing medium discharge apparatus 84 after a predetermined time is elapsed from when the printing medium discharge apparatus 84 is operated at a low speed, the printing medium discharge apparatus 84 is operated again at a high speed. This operation is carried out in order that the printing medium P on which an image has been printed is not prevented from being introduced toward the printing medium discharge apparatus 84 from the rotary drum 12.

Modification

In a further another modification, like in the modification just described above with reference to FIGS. 15A and 15B, operation of the printing medium discharge apparatus 84 can be controlled as will be described below. Specifically, the printing medium discharge apparatus 84 of this modification discharges the printing medium P on which an image has been printed, at the same speed as the circumferential speed of the outer circumferential surface 12*a* of the rotary drum 12 until the rear end of the printing medium P from the rotary drum 12 is separated from the rotary drum 12. After the rear end of the printing medium P is separated from the rotary drum 12, the printing medium discharge apparatus 84 further discharges the printing medium P at a lower speed than the circumferential speed of the outer circumferential surface 12*a* of the rotary drum 12 until a next printing medium on which an image has been printed is introduced into the printing medium carry and discharge device from the rotary drum 12.

Figure 16A:
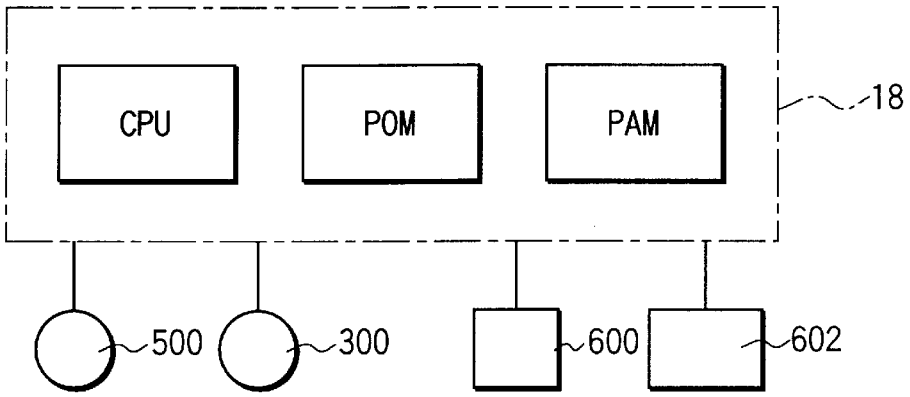
FIG. 16A is a block diagram of a controller unit for controlling an operation of a more further modification of the printing medium discharge apparatus shown in FIGS. 3A, 3B and 3C.
Figure 16B:
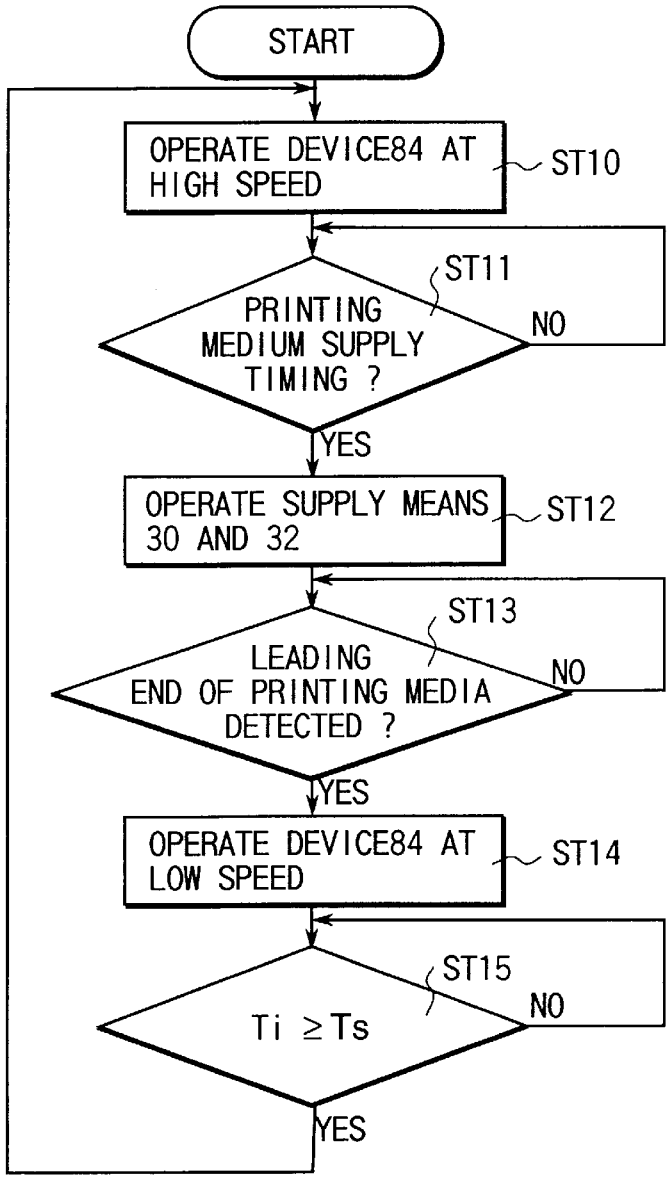
FIG. 16B is a flow chart schematically showing a flow of the operation of the more further modification of the printing medium discharge apparatus shown in FIGS. 3A, 3B and 3C.

FIG. 16A shows a schematic block diagram of the controller unit 18 for controlling operation of this further another modification of the printing medium discharge apparatus 84 shown in FIGS. 3A, 3B, and 3C. FIG. 16B shows a schematic flow of operation of this further another modification of the printing medium discharge apparatus shown in FIGS. 3A, 3B, and 3C.

As can be seen from FIG. 16A, the controller unit 18 for controlling operation of this further another modification also comprises a CPU, a ROM, and a RAM, and is connected with the motor 500 as a rotation drive source for a pair of transfer rollers 28 and 30 shown in FIG. 1, the motor 300 as a rotation drive source for the printing medium discharge apparatus 84 shown in FIGS. 13A and 13B, a printing medium detecting device 600 provided for the printing medium discharge apparatus 84 as shown in FIG. 1, and a timer 602. Here, the printing medium detecting device 600 may be, for example, a known optical detector.

As shown in FIG. 1, the printing medium discharge apparatus 84 shown in FIG. 1 is operated at the same speed (or high speed) as the predetermined circumferential speed of the outer circumferential surface 12*a* of the rotary drum 12 (ST10). The pair of transfer rollers 30 and 32 of the printing medium feeding device 28 supply the printing medium P at a timing (ST11) detected by the detecting device 52 toward the outer circumferential surface 12*a* of the rotary drum 12 rotating at the predetermined speed in the predetermined direction X. As a result of this, the printing medium P from the pair of transfer rollers 30 and 32 is held at the predetermined position (by the printing medium holding device) on the circumferential surface of the rotary drum 12 with the front end of the printing medium P situated at the predetermined position Y around the outer circumferential surface 12*a* of the rotary drum 12. While the rotary drum 12 rotates by the predetermined number of rotations after the printing medium P is thus held on the outer circumferential surface 12*a* of the rotary drum 12 and is suctioned by the suction force of the charge, the printing equipment 64 performs printing of a predetermined image on the printing medium P. After rotation of the rotary drum 12 for the predetermined number of rotations is completed for printing, the printing medium holding device releases holding of the front end of the printing medium P and the removing device 62 removes the printing medium P on which an image has been printed, from the outer circumferential surface of the rotary drum 12. Until the printing medium detecting device 600 detects the front end of the printing medium P introduced into the printing medium discharge apparatus 84 (ST13), the printing medium discharge apparatus 84 is operated at the same speed (or high speed) as the predetermined circumferential speed of the outer circumferential surface 12*a* of the rotary drum 12. Further, after the detection is carried out, the printing medium discharge apparatus 84 is operated at a lower speed (or low speed) than the predetermined circumferential speed of the outer circumferential surface 12*a* of the rotary drum 12 (ST14). Note that the rear end of the printing medium P on which an image has been printed is separated from the outer circumferential surface of the rotary drum 12 when the printing medium detecting device 600 detects the front end of the printing medium P introduced into the printing medium discharge apparatus. This operation is carried out in order to sufficiently dry ink in the image formation region on the image formation surface of the printing medium P on which an image has been printed. When the timer 602 counts an elapse of a predetermined time Ts after the printing medium discharge apparatus is operated at the low speed, the printing medium discharge apparatus 84 is operated again at the high speed. The predetermined time Ts is set to be smaller than a predetermined time Ti which is required for a next printing medium P on which an image has been printed is introduced into the printing media discharge apparatus 84 from the rotary drum. This operation is carried out in order that a next printing medium P on which an image has been printed is not prevented from being introduced toward the printing medium discharge apparatus 84.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printing medium discharge apparatus for use in discharging a printing medium from a rotary drum in an ink jet printer, a rotation speed of which is constant from a time of introduction of the printing medium onto the rotary drum to a time of discharge of the printing medium from the rotary drum through printing of an image onto the printing medium by an ink jet while holding the printing medium on the rotary drum, said apparatus comprising:

a printing medium carry and discharge device carrying thereon the printing medium, on which the image has been printed, from the rotary drum, to make a non-image formation surface of the printing medium including a non-image formation region contact the printing medium carry and discharge device, and discharging the printing medium carried thereon to be moved apart from the rotary drum; and a printing medium press device pressing an image formation surface including an image formation region of the printing medium carried on the printing medium carry and discharge device, against the printing medium carry and discharge device, to thereby prevent the printing medium from floating up from the printing medium carry and discharge device while the printing medium is discharged by the printing medium carry and discharge device.

2. A printing medium discharge apparatus according to claim 1, wherein:

the image formation surface of the printing medium carried on the printing medium carry and discharge device includes a pair of non-image formation regions extending in a discharging direction of the printing medium at both widthwise end portions positioned in a direction perpendicular to the discharging direction of the printing medium in which the printing medium is discharged by the printing medium carry and discharge device, on the image formation surface, thus arranging the image formation surface of the printing medium between the pair of non-image formation regions, and the printing medium press device comprises a pair of belt units extending in the discharging direction of the printing medium along the pair of non-image formation regions of the printing medium carried on the printing medium carry and discharge device.

3. A printing medium discharge apparatus according to claim 1, wherein the printing medium carry and discharge device discharges the printing medium at a speed equal to a circumferential speed of an outer circumferential surface of the rotary drum until a rear end of the printing medium from the rotary drum is separated from the rotary drum, and discharges the printing medium at a speed lower than the circumferential speed of the outer circumferential surface of the rotary drum after the rear end of the printing medium is separated from the rotary drum until a next printing medium on which an image is printed is introduced onto the printing medium carry and discharge device.

4. A printing medium discharge apparatus for use in an ink jet printer that prints an image by ink jet on a printing medium while the printing medium is held on a rotary drum, said discharge apparatus discharging the printing medium, on which the image has been printed, from the rotary drum, and a rotation speed of the rotary drum being constant from a time of introduction of the printing medium onto the rotary drum to a time of discharge of the printing medium from the rotary drum through printing of the image on the printing medium on the rotary drum, said apparatus comprising:

an ink drying device for drying ink in an image formation region of the printing medium being discharged by the printing medium discharge apparatus, and wherein the printing medium discharge apparatus discharges the printing medium at a speed equal to a circumferential speed of an outer circumferential surface of the rotary drum until a rear end of the printing medium from the rotary drum is separated from the rotary drum, and discharges the printing medium at a speed lower than the circumferential speed of the outer circumferential surface of the rotary drum after the rear end of the printing medium is separated from the rotary drum until a next printing medium on which an image is printed is introduced to the printing medium discharge apparatus.

5. A printing medium discharge apparatus for use in discharging a printing medium from a rotary drum in an ink jet printer that prints an image onto the printing medium by an ink jet while holding the printing medium on the rotary drum, said apparatus comprising:

a printing medium carry and discharge device carrying thereon the printing medium, on which the image has been printed, from the rotary drum, to make a non-image formation surface of the printing medium including a non-image formation region contact the printing medium carry and discharge device, and discharging the printing medium carried thereon to be moved apart from the rotary drum; and a printing medium press device pressing an image formation surface including an image formation region of the printing medium carried on the printing medium carry and discharge device, against the printing medium carry and discharge device, to thereby prevent the printing medium from floating up from the printing medium carry and discharge device while the printing medium is discharged by the printing medium carry and discharge device, wherein the image formation surface of the printing medium carried on the printing medium carry and discharge device includes a pair of non-image formation regions extending in a discharging direction of the printing medium at both widthwise end portions positioned in a direction perpendicular to the discharging direction of the printing medium in which the printing medium is discharged by the printing medium carry and discharge device, on the image formation surface, thus arranging the image formation surface of the printing medium between the pair of non-image formation regions, and wherein the printing medium press device comprises a pair of belt units extending in the discharging direction of the printing medium along the pair of non-image formation regions of the printing medium carried on the printing medium carry and discharge device.

6. A printing medium carry and discharge apparatus according to claim 5, wherein:

the printing medium press device includes a press roller pressing the image formation region on the image formation surface of the printing medium carried on the printing medium carry and discharge device between the pair of belt units, against the printing medium carry and discharge device, and the press roller has a circumferential area whose width is smaller than a width of the press roller at a center portion thereof.

7. A printing medium discharge apparatus according to claim 6, wherein a circumferential surface of the press roller is divided into a plurality of sections by a plurality of notches which are separated from each other in a circumferential direction of the circumferential surface of the press roller.

8. A printing medium discharge apparatus according to claim 7, wherein the press roller is rotatable in the discharging direction of the printing medium, and the printing medium press device includes a cleaning member for cleaning the circumferential surface of the press roller.

9. A printing medium discharge apparatus according to claim 6, wherein the press roller is rotatable in the discharging direction of the printing medium, and the printing medium press device includes a cleaning member for cleaning a circumferential surface of the press roller.

10. A printing medium discharge apparatus for use in discharging a printing medium from a rotary drum in an ink jet printer, a rotation speed of which is constant from a time of introduction of the printing medium onto the rotary drum to a time of discharge of the printing medium from the rotary drum through printing of an image onto the printing medium by an ink jet while holding the printing medium on the rotary drum, said apparatus comprising:

a printing medium carry and discharge device carrying thereon the printing medium, on which the image has been printed, from the rotary drum, to make a non-image formation surface of the printing medium including a non-image formation region contact the printing medium carry and discharge device, and discharging the printing medium carried thereon to be moved apart from the rotary drum; and a printing medium press device pressing an image formation surface including an image formation region of the printing medium carried on the printing medium carry and discharge device, against the printing medium carry and discharge device, to thereby prevent the printing medium from floating up from the printing medium carry and discharge device while the printing medium is discharged by the printing medium carry and discharge device, wherein the printing medium carry and discharge device discharges the printing medium at a speed equal to a circumferential speed of an outer circumferential surface of the rotary drum until a rear end of the printing medium from the rotary drum is separated from the rotary drum, and discharges the printing medium at a speed lower than the circumferential speed of the outer circumferential surface of the rotary drum after the rear end of the printing medium is separated from the rotary drum until a next printing medium on which an image is printed is introduced onto the printing medium carry and discharge device.

11. A printing medium discharge apparatus according to claim 10, further comprising an ink drying surface for drying ink in the image formation region on the image formation surface of the printing medium carried on the printing medium carry and discharge device.

* * * * *